US010583408B2

(12) United States Patent
Panagiotou et al.

(10) Patent No.: US 10,583,408 B2
(45) Date of Patent: Mar. 10, 2020

(54) INTERACTION CHAMBERS WITH REDUCED CAVITATION

(71) Applicant: MICROFLUIDICS INTERNATIONAL CORPORATION, Westwood, MA (US)

(72) Inventors: Thomai Panagiotou, Winchester, MA (US); Yang Su, Newton, MA (US)

(73) Assignee: MICROFLUIDICS INTERNATIONAL CORPORATION, Westwood, MA (US)

( * ) Notice: Subject to any disclaimer, the term of this patent is extended or adjusted under 35 U.S.C. 154(b) by 0 days.

(21) Appl. No.: 15/492,440

(22) Filed: Apr. 20, 2017

(65) Prior Publication Data

US 2017/0216784 A1 Aug. 3, 2017

Related U.S. Application Data

(63) Continuation of application No. 14/725,750, filed on May 29, 2015, now Pat. No. 9,656,222.

(Continued)

(51) Int. Cl.
*B01F 3/08* (2006.01)
*B01F 5/06* (2006.01)

(Continued)

(52) U.S. Cl.
CPC ..... *B01F 3/0807* (2013.01); *B01F 5/0256* (2013.01); *B01F 5/0268* (2013.01);

(Continued)

(58) Field of Classification Search
CPC .. B01F 3/0807; B01F 13/0061; B01F 5/0644; B01F 5/0648; B01F 5/0661; B01F 13/0064; B01F 2003/0834

(Continued)

(56) References Cited

U.S. PATENT DOCUMENTS 3,574,485 A * 4/1971 Herman, Jr. ..... B01F 13/0809 417/50
4,963,498 A * 10/1990 Hillman ..... B01F 5/0618 356/28

(Continued)

FOREIGN PATENT DOCUMENTS

DE 19626246 1/1998
EP 2090353 8/2009

(Continued)

OTHER PUBLICATIONS

International Search report for international patent application No. PCT/US2015/33249 dated Sep. 4, 2015 (5 pages).

(Continued)

*Primary Examiner* — Marc C Howell
(74) *Attorney, Agent, or Firm* — K&L Gates LLP

(57) ABSTRACT

Apparatuses and methods that reduce cavitation in interaction chambers are described herein. In an embodiment, an interaction chamber for a fluid processor or fluid homogenizer includes an inlet chamber having an inlet hole and a bottom end, an outlet chamber having an outlet hole and a top end, a microchannel placing the inlet hole in fluid communication with the outlet hole, wherein an entrance to the microchannel from the inlet chamber is offset a distance from the bottom end, and at least one of: (i) a tapered fillet located on a side wall of the microchannel at the microchannel entrance; (ii) a side wall of the microchannel converging inwardly from the inlet chamber to the outlet chamber; (iii) a top wall and/or bottom wall of the microchannel angled from the inlet chamber to the outlet chamber; and (iv) a top fillet that extends around a diameter of inlet chamber.

19 Claims, 25 Drawing Sheets

Related U.S. Application Data

(60) Provisional application No. 62/005,783, filed on May 30, 2014.

(51) Int. Cl.
*B01F 5/02* (2006.01)
*B01F 13/00* (2006.01)

(52) U.S. Cl.
CPC ..... *B01F 5/0644* (2013.01); *B01F 5/0648* (2013.01); *B01F 5/0661* (2013.01); *B01F 13/0059* (2013.01); *B01F 13/0064* (2013.01); *B01F 2003/0834* (2013.01)

(58) Field of Classification Search
USPC ..... 366/DIG. 1–DIG. 4
See application file for complete search history.

(56) References Cited

U.S. PATENT DOCUMENTS

| | | | | |
|---|---|---|---|---|
| 5,164,598 | A | 11/1992 | Hillman et al. | |
| 5,534,328 | A | 7/1996 | Ashmead et al. | |
| 5,965,410 | A | 10/1999 | Chow et al. | |
| 5,971,158 | A * | 10/1999 | Yager | B01J 19/0093 209/155 |
| 5,993,750 | A | 11/1999 | Ghosh et al. | |
| 6,062,681 | A * | 5/2000 | Field | B41J 2/17596 347/65 |
| 6,167,910 | B1 | 1/2001 | Chow | |
| 6,457,854 | B1 | 10/2002 | Koop et al. | |
| 8,088,215 | B2 | 1/2012 | Takahashi | |
| 8,187,554 | B2 | 5/2012 | Panagiotou et al. | |
| 8,367,004 | B2 | 2/2013 | Panagiotou et al. | |
| 2006/0243590 | A1 | 11/2006 | Egawa | |
| 2007/0178582 | A1 | 8/2007 | Koser | |
| 2008/0078446 | A1 | 4/2008 | Fujiwara | |
| 2008/0276729 | A1 | 11/2008 | Joung | |
| 2009/0241801 | A1 | 10/2009 | Takahashi et al. | |
| 2011/0162982 | A1 * | 7/2011 | Kraus | A61K 9/0019 206/223 |
| 2011/0165193 | A1 * | 7/2011 | Rueckl | A61K 9/0019 424/209.1 |
| 2012/0175442 | A1 | 7/2012 | Xiong et al. | |
| 2012/0263012 | A1 | 10/2012 | Xiong et al. | |
| 2012/0263013 | A1 | 10/2012 | Xiong et al. | |
| 2013/0189311 | A1 | 7/2013 | Rueckl et al. | |

FOREIGN PATENT DOCUMENTS

| | | |
|---|---|---|
| EP | 2586521 | 5/2013 |
| JP | S57-190820 | 11/1982 |
| JP | 10-503884 | 4/1998 |
| JP | 2000-235954 | 8/2000 |
| JP | 2000-513268 | 10/2000 |
| JP | 2008-86889 | 4/2008 |
| JP | 2013-512891 | 4/2013 |
| WO | 96/04516 | 2/1996 |
| WO | WO9800228 | 1/1998 |
| WO | WO 2006/105870 | 10/2006 |
| WO | WO 2009/033000 | 3/2009 |

OTHER PUBLICATIONS

Written Opinion for international patent application No. PCT/US2015/33249 dated Sep. 4, 2015 (5 pages).
Search Report and Opinion dated May 25, 2018 for European Patent Application No. 15800529.8.
English Translation of Office Action dated Apr. 2, 2019 issued for corresponding Japanese patent application No. 2017-515030.
Office Action dated Jan. 7, 2020 issued for Japanese patent application No. 2017-515030.

* cited by examiner

INTERACTION CHAMBERS WITH REDUCED CAVITATION

PRIORITY

This application is a continuation of U.S. patent application Ser. No. 14/725,750, entitled "Interaction Chambers with Reduced Cavitation", filed May 29, 2015, which claims priority to U.S. Provisional Application No. 62/005,783, filed May 30, 2014, the entire contents of each of which is incorporated herein by reference.

FIELD OF THE INVENTION

The present disclosure generally relates to apparatuses and methods that reduce cavitation in interaction chambers, and more specifically to apparatuses and methods that reduce cavitation in interaction chambers used in fluid processors and homogenizers, for example, high shear fluid processors and high pressure homogenizers.

BACKGROUND

Interaction chambers typically operate by flowing fluid from one or more inlet cylinders, through one or more microchannels, and out one or more outlet cylinders. The transition of the fluid flow into the microchannels can lead to cavitation, a physical phenomenon of formation of vapor cavities (bubbles) inside a liquid. Cavitation is the consequence of rapid changes in pressure. When pressure drops below a vaporization pressure, liquid boils and forms vapor bubbles.

There are several disadvantages associated with cavitation inside a microchannel. First, the cavities can implode as the fluid pressure recovers downstream and can generate an intense shockwave. This can cause significant damage to the internal surface of the interaction chamber and downstream piping (e.g., the wear of the components that greatly reduces chamber performance and life). Cavitation can also introduce local high temperature spots, causing damage to certain heat sensitive materials. Second, since the formed cavities stay and occupy a certain volume inside the microchannel, the flow through the microchannel can be blocked and plugging issues can occur when processing certain solid dispersions or materials with high aspect ratios. Third, with the reduced available cross-sectional area near the microchannel entrance, the place with the most severe cavitation, the flow rate is limited and subsequently results in a lower average flow velocity at the channel exit. This can reduce the energy of the fluid at the micro channel exit and lead to the reduction of process efficiency for certain applications.

SUMMARY

The present disclosure provides interaction chambers that reduce cavitation and increase fluid velocity through microchannels. It has been determined that the interaction chambers described herein provide one or more of: (i) reduced plugging due to the reduction/elimination of cavitation; (ii) higher processing efficiency due to higher post microchannel energy; (iii) lower local temperatures inside the microchannels, leading to the ability to handle different heat-sensitive materials; and (iv) less wear in the microchannels, leading to longer chamber life.

In a general example embodiment, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, wherein an entrance to the microchannel from the inlet chamber is offset a distance from the bottom end of the inlet chamber, and at least one of: (i) at least one tapered fillet located on at least one side wall of the microchannel at the microchannel entrance; (ii) at least one side wall of the microchannel converging inwardly from the inlet chamber to the outlet chamber; (iii) at least one of a top wall and a bottom wall of the microchannel angled from the inlet chamber to the outlet chamber; and (iv) a top fillet that extends around a diameter of inlet chamber.

In another general example embodiment, a multi-slotted interaction chamber for a fluid processor or fluid homogenizer, preferably a high shear processor or a high pressure homogenizer, includes an inlet chamber, preferably an inlet cylinder, having an inlet hole and a bottom end, an inlet plenum in fluid communication with the inlet hole, an outlet chamber, preferably an outlet cylinder, having an outlet hole and a top end, an outlet plenum in fluid communication with the outlet hole, a plurality of microchannels connecting the inlet plenum to the outlet plenum and thereby fluidly connecting the inlet hole with the outlet hole, each of the plurality of microchannels including a microchannel entrance offset a distance from the bottom end of the inlet chamber, wherein at least one of: (i) a width of the inlet plenum is less than a diameter of the inlet chamber; and (ii) a height of the inlet plenum interrupts the diameter of the inlet chamber.

In another general example embodiment, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, and means for reducing cavitation as fluid enters the microchannel from the inlet chamber.

In another general example embodiment, an interaction chamber for a fluid processor or fluid homogenizer, preferably a high shear processor or high pressure homogenizer, includes an entry chamber, preferably an entry cylinder, an outlet chamber, preferably an outlet cylinder, and a microchannel in fluid communication with the entry chamber and outlet chamber, the microchannel having an inlet and an outlet, wherein the entry chamber has an inlet hole at or near the top of the entry chamber and a bottom, and receives the microchannel inlet at a position above the bottom of the entry chamber.

In another general example embodiment, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, wherein an exit from the microchannel to the outlet chamber is offset a distance from the top end of the outlet chamber, and at least one of: (i) at least one tapered fillet located on at least one side wall of the microchannel at the microchannel exit; (ii) at least one side wall of the microchannel converging inwardly from the inlet chamber to the outlet chamber; (iii) at least one of a top wall and a bottom wall of the microchannel angled from the inlet chamber to the outlet chamber; and (iv) a top fillet that extends around a diameter of inlet chamber.

In another general example embodiment, a fluid processing system includes an auxiliary processing module (APM) positioned upstream or downstream of an interaction chamber described herein.

In another general example embodiment, a method of producing an emulsion includes passing fluid through an interaction chamber described herein.

In another general example embodiment, a method of producing reducing particle size includes passing a particle stream through an interaction chamber described herein.

In another general example embodiment, a fluid processing system includes an interaction chamber described herein and causes fluid to flow above 0 kpsi and below 40 kpsi within a microchannel of the interaction chamber.

BRIEF DESCRIPTION OF THE FIGURES

Embodiments of the present disclosure will now be explained in further detail by way of example only with reference to the accompanying figures, in which.

DETAILED DESCRIPTION

Before the disclosure is described, it is to be understood that this disclosure is not limited to the particular apparatuses and methods described. It is also to be understood that the terminology used herein is for the purpose of describing particular embodiments only, and is not intended to be limiting, since the scope of the present disclosure will be limited only to the appended claims.

As used in this disclosure and the appended claims, the singular forms "a," "an" and "the" include plural referents unless the context clearly dictates otherwise. The methods and apparatuses disclosed herein may lack any element that is not specifically disclosed herein.

Figure 1:
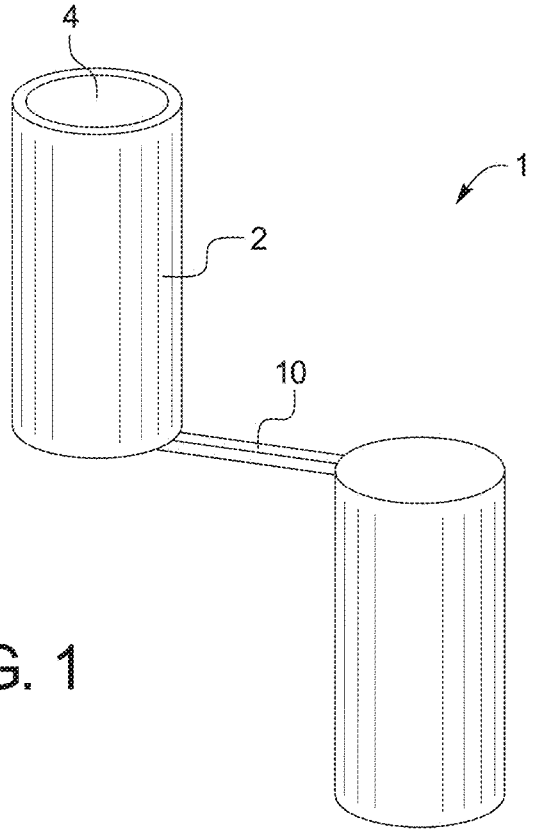
FIG. 1 depicts a top perspective view of an example embodiment of an interaction chamber.
Figure 2:
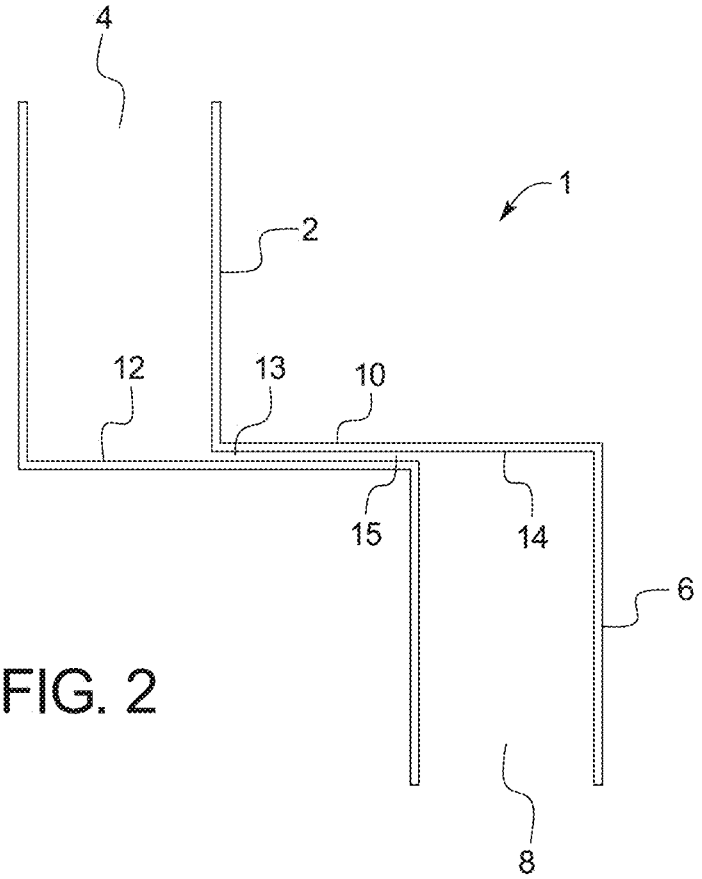
FIG. 2 depicts a side cross-sectional view of the interaction chamber of FIG. 1.

FIGS. 1 and 2 show the general shape and schematic of the working section of an interaction chamber 1. Interaction chamber 1 includes an inlet chamber 2 with an inlet hole 4, an outlet chamber 6 with an outlet hole 8, and a microchannel 10 joining inlet chamber 2 to outlet chamber 6 and placing inlet hole 4 in fluid communication with outlet hole 8. Inlet chamber 2 and outlet chamber 6 are preferably cylinders. In FIGS. 1 and 2, microchannel 10 joins inlet chamber 2 to outlet chamber 6 at the bottom end 12 of inlet chamber 4 and at the top end 14 of outlet chamber 6. That is, bottom end 12 and top end 14 do not extend past microchannel 10. The opening where inlet chamber 2 meets microchannel 10 is the microchannel entrance 13, and the opening where microchannel 10 meets outlet chamber 6 is the microchannel exit 15. As described in more detail below, cavitation often occurs at the microchannel entrance 13.

The interaction chamber 1 of FIGS. 1 and 2 is generally referred to as a Z-type interaction chamber herein due to its Z-shape formed by a single inlet and a single outlet. Z-type chambers such as interaction chamber 1 are useful in reducing particle size by generating high shear inside the microchannel and impinging fluid on the outer chamber wall.

In use, incoming fluid enters inlet hole 4, passes through inlet chamber 2, and then enters microchannel 10 with a ninety degree turn around microchannel entrance 13. The fluid then exits microchannel 10 into outlet chamber 6 with another ninety degree turn around microchannel exit 15, passes through outlet chamber 6, and exits through outlet hole 8. After exiting microchannel 10, the fluid flow forms a jet that is restricted at one side by top end 14 of outlet chamber 6.

Figure 3:
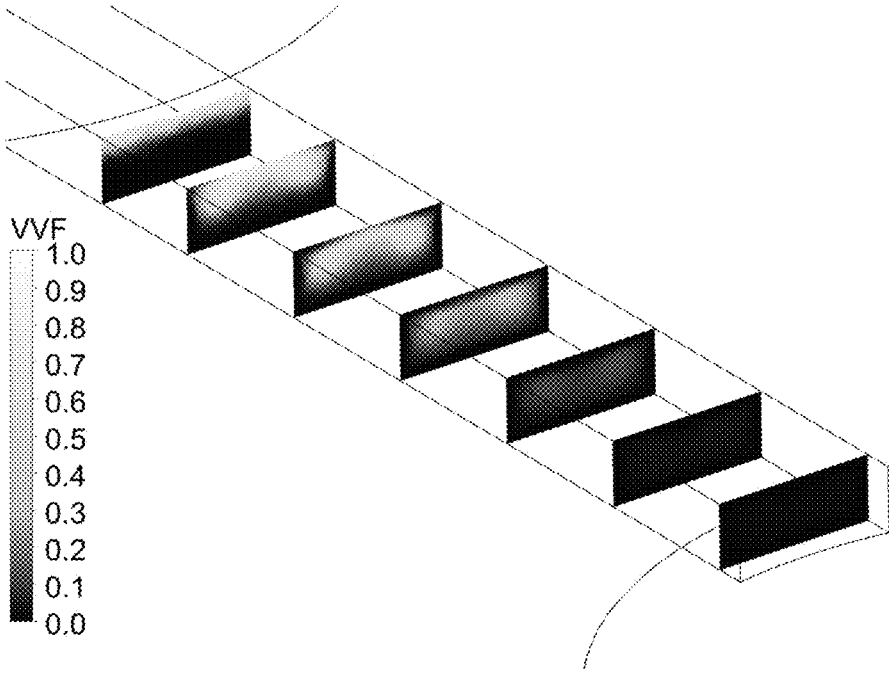
FIG. 3 depicts a diagram of the cavitation effect of the interaction chamber of FIG. 1.
Figure 4:
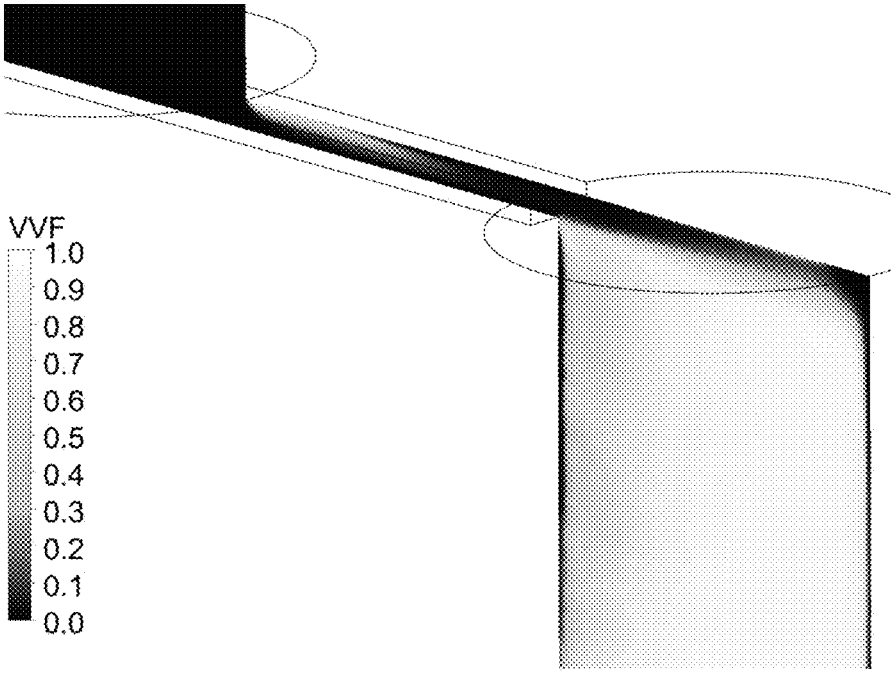
FIG. 4 depicts a diagram of the cavitation effect of the interaction chamber of FIG. 1.

The transition of the fluid flow into microchannel 10 with a sharp turn at microchannel entrance 13 usually leads to cavitation. FIGS. 3 and 4 show a diagram of the cavitation effect using a computational fluid dynamics simulation. In FIG. 3, the vapor volume fraction (VVF) is plotted as contour plots at different cross-sectional locations inside the micro channel as well as the microchannel entrance and exit. In the VVF plot of FIG. 3, as well as the other VVF plots disclosed herein, zero (0) represents a pure liquid phase, and one (1) represents a pure vapor phase. By convention, VVF≥0.5 usually indicates vapor phase. Anything generally above 0.5 can be considered undesirable because it indicates a vapor pocket, where the cross-sectional area of the microchannel is reduced, which reduces the flowrate through the microchannel. As indicated in FIG. 4, which shows the entire fluid passage from inlet chamber 2 through microchannel 10 to outlet chamber 6, cavitation often occurs in two places inside the interaction chamber: (i) the microchannel entrance area; and (ii) the exit hole.

Figure 5:
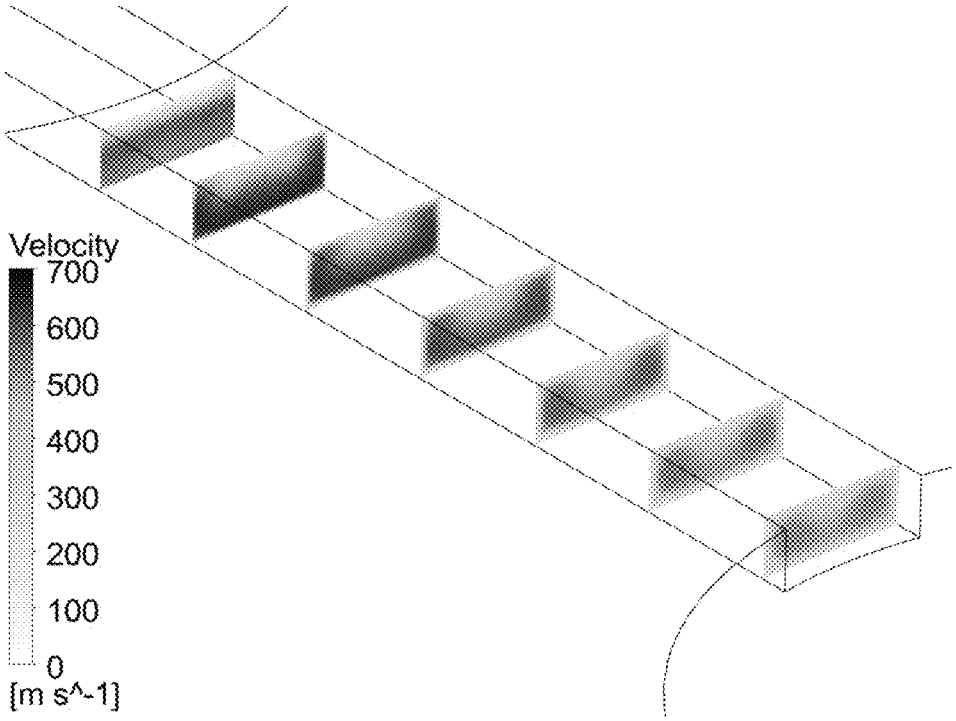
FIG. 5 depicts a diagram of the velocity distribution inside the interaction chamber of FIG. 1.

FIG. 5 shows an example of the velocity distribution inside microchannel 10. As illustrated, the fluid velocity is initially non-uniform near the microchannel entrance due to the presence of cavities. The velocity then gradually becomes more uniform at the downstream end of the channel, and the magnitude also decreases. The lower channel exit velocity means that the fluid will carry less kinetic energy for dissipation or impact in the outlet region. The energy dissipation is directly related to the final particle size for many processes such as emulsification processes, where higher energy dissipation usually leads to smaller particle size. The energy dissipation can impair the system's ability to create suitable fine particle sizes. The force/pressure spikes produced by the shock waves, however, can help homogenize, or mix and break down, the particles to achieve smaller particle size and distribution. Thus, while microchannel entrance cavitation is usually an undesired phenomenon, outlet cavitation is a favorable phenomenon for some applications. In general, system performance can be enhanced if cavitation is controlled.

Figure 6:
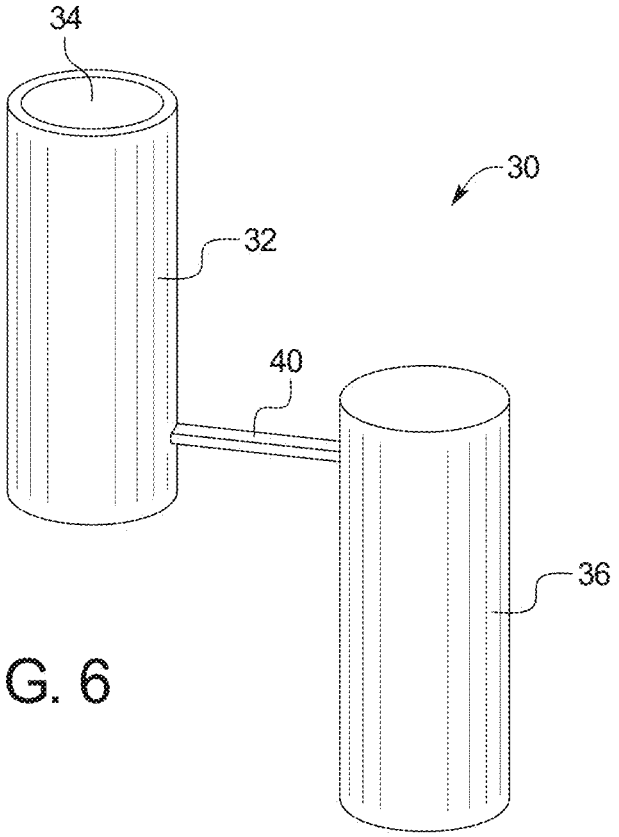
FIG. 6 depicts a top perspective view of an example embodiment of an interaction chamber.
Figure 7:
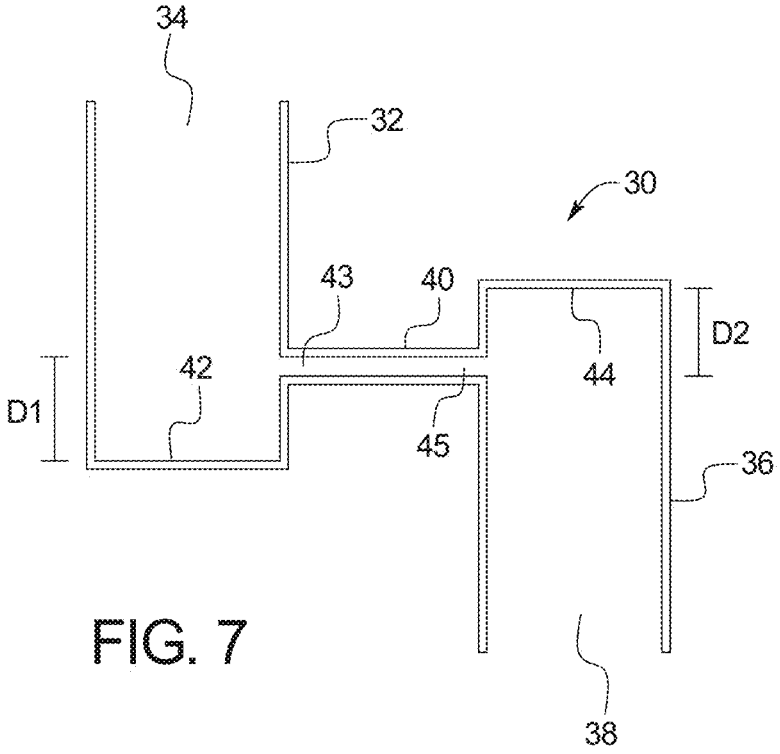
FIG. 7 depicts a side cross-sectional view of the interaction chamber of FIG. 6.

FIGS. 6 and 7 show an example embodiment of the working section of an improved H-type interaction chamber 30 according to the present disclosure. Interaction chamber 30 includes an inlet chamber 32 with an inlet hole 34, an outlet chamber 36 with an outlet hole 38, and a microchannel 40 joining inlet chamber 32 to outlet chamber 36 and placing inlet hole 34 in fluid communication with outlet hole 38. Inlet chamber 32 and outlet chamber 36 are preferably cylinders. Microchannel 40 includes a microchannel entrance 43 where microchannel 40 meets inlet chamber 32 and a microchannel exit 45 where microchannel 40 meets outlet chamber 36. As illustrated, microchannel 40 is located a distance D1 from bottom end 42 of inlet chamber 32 and a distance D2 from top end 44 of outlet chamber 36. D1 and D2 can be the same or different distances. In an embodiment, D1 and D2 can be in the range of 0.001 to 1 inch, or preferably 0.01 to 0.03 inches. It has been determined that adding the distances D1 and D2 between microchannel 40 and bottom end 42 and/or top end 44 of interaction chamber 30 streamlines the flow when it enters microchannel 40 and reduces the level of cavitation at the microchannel entrance 43 and microchannel exit 45. That is, disposing the microchannel 40 above bottom end 42 creates a pool of fluid at bottom end 42, which deters cavitation.

The interaction chamber 30 of FIGS. 6 and 7 is generally referred to as an H-type interaction chamber herein due to its H-shape formed by a single inlet and a single outlet. The difference between an H-chamber and a Z-chamber is the distance from the microchannel entrance to the bottom end of the inlet chamber and/or the distance from the microchannel exit to the top end of the outlet chamber. Like Z-type chambers, H-type chambers such as interaction chamber 30 are useful in reducing particle size by generating high shear inside the microchannel and impinging fluid on the outer chamber wall.

Figure 8:
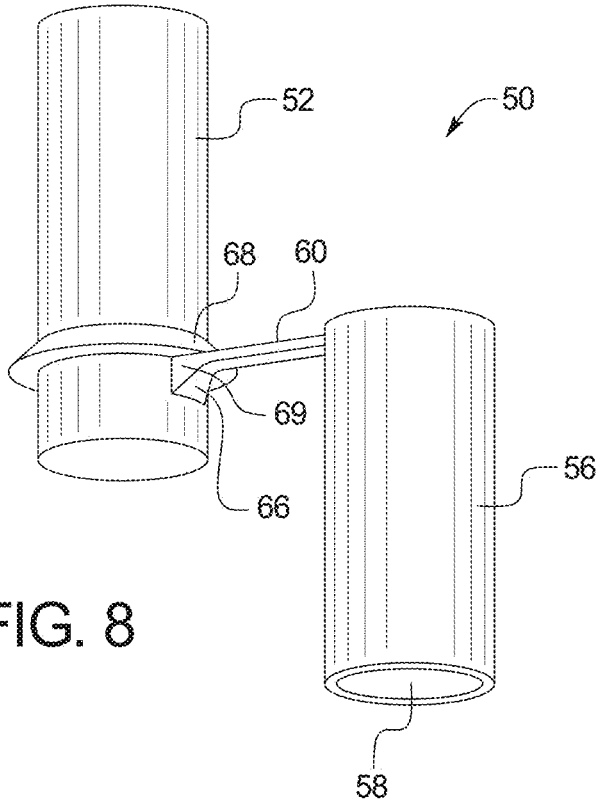
FIG. 8 depicts a bottom perspective view of an example embodiment of an interaction chamber.
Figure 9:
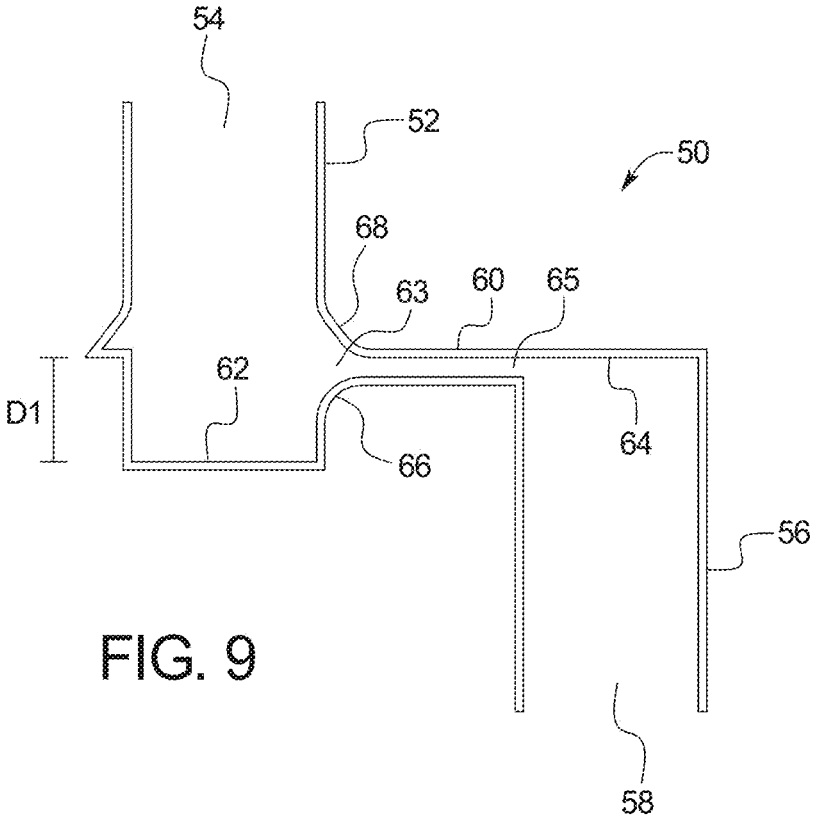
FIG. 9 depicts a side cross-sectional view of the interaction chamber of FIG. 8.

FIGS. 8 and 9 show another example embodiment of the working section of an improved H-type interaction chamber 50 according to the present disclosure. Interaction chamber 50 includes an inlet chamber 52 with an inlet hole 54, an outlet chamber 56 with an outlet hole 58, and a microchannel 60 joining inlet chamber 52 to outlet chamber 56 and placing inlet hole 54 in fluid communication with outlet hole 58. Inlet chamber 52 and outlet chamber 56 are preferably cylinders. Microchannel 60 includes a microchannel entrance 63 where microchannel 60 meets inlet chamber 52 and a microchannel exit 65 where microchannel 60 meets outlet chamber 56. Like microchannel 40, microchannel 60 is located a distance D1 from bottom end 62 of inlet chamber 52. Interaction chamber 50 further removes the sharp edges around microchannel entrance 63 by adding tapered fillets 66, 68, which are preferably rounded. In an embodiment, the tapered fillets 66, 68 can be in the range of 0.001 to 1 inch, or preferably 0.003 to 0.01 inches. In the embodiment shown, bottom fillet 66 is located only at microchannel 60 (i.e., is only as wide as the microchannel), whereas top fillet 68 surrounds the entire diameter of inlet chamber 52. This configuration is advantageous because it is easier to manufacture top fillet 68 as surrounding the entire diameter of inlet chamber 52 (as opposed to making top fillet 68 only as wide as microchannel 60), and the configuration offers comparable results. To manufacture inlet chamber 52, a first inlet chamber portion including top fillet 68 can be added to a second inlet chamber portion so that top fillet 68 is placed directly above microchannel 60. In an embodiment, the first inlet chamber portion is the portion of inlet chamber 52 in FIGS. 8 and 9 including and above top fillet 68, and the second inlet chamber portion is the portion of inlet chamber 52 in FIGS. 8 and 9 below top fillet 68.

Either of bottom fillet 66 or top fillet 68 can be made to surround the entire diameter of inlet chamber 52, or either fillet can be located only at the microchannel entrance 63. Microchannel 50 can further include side fillets 69 at the two side walls of microchannel entrance 63. Microchannel exit 65 can also be formed in the same way as microchannel entrance 63, that is, with top, bottom and/or side fillets and with a distance between top end 64 of outlet chamber 56 and microchannel exit 65. It has been determined that interaction chamber 50 provides a streamlined flow pattern and completely removes cavitation.

Figure 10:
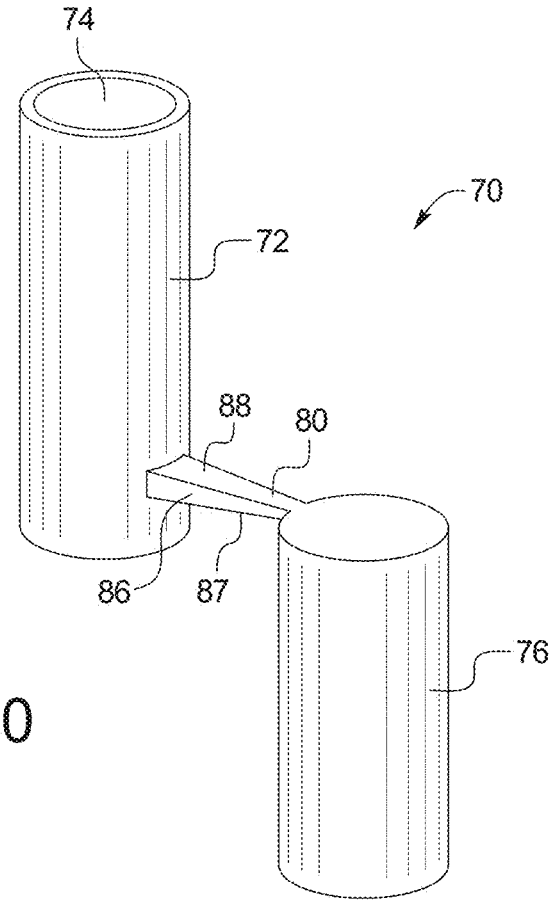
FIG. 10 depicts a top perspective view of an example embodiment of an interaction chamber.
Figure 11:
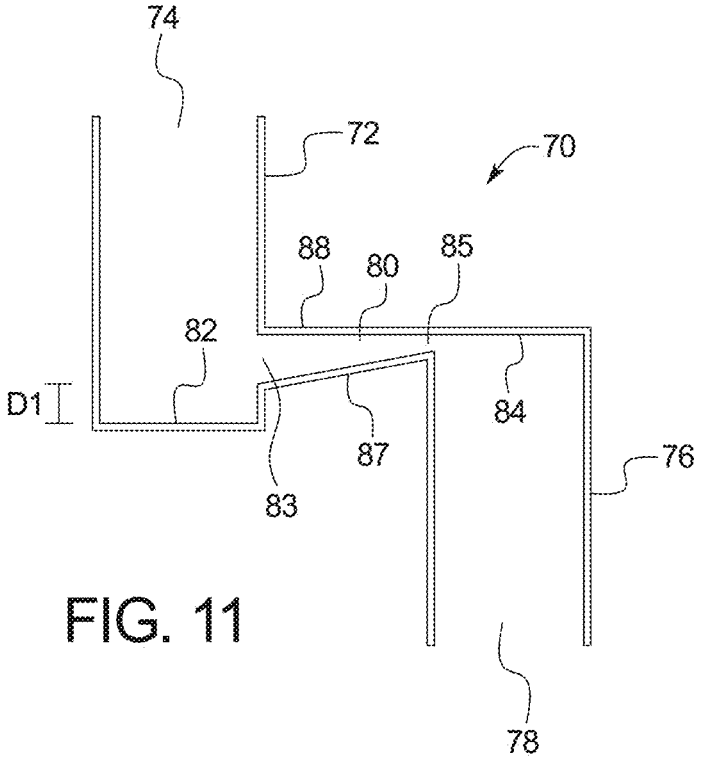
FIG. 11 depicts a side cross-sectional view of the interaction chamber of FIG. 10.
Figure 12:
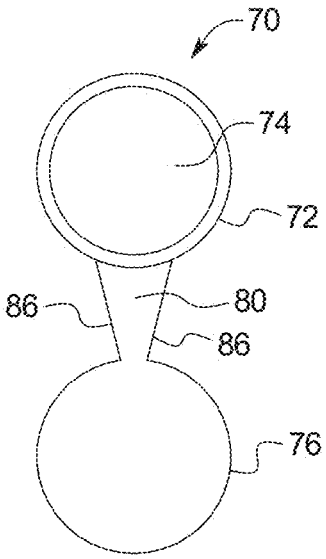
FIG. 12 depicts a top view of the interaction chamber of FIG. 10.

FIGS. 10 to 12 show another example embodiment of the working section of an improved H-type interaction chamber 70 according to the present disclosure. Interaction chamber 70 includes an inlet chamber 72 with an inlet hole 74, an outlet chamber 76 with an outlet hole 78, and a microchannel 80 joining inlet chamber 72 to outlet chamber 76 and placing inlet hole 74 in fluid communication with outlet hole 78. Inlet chamber 72 and outlet chamber 76 are preferably cylinders. Microchannel 80 includes a microchannel entrance 83 where microchannel 80 meets inlet chamber 72 and a microchannel exit 85 where microchannel 80 meets outlet chamber 76. Like microchannel 40, microchannel 80 is located a distance D1 from bottom end 82 of inlet chamber 72. Microchannel 80 can also be formed a distance from top end 84 of outlet chamber 76. Interaction chamber 70 further drafts the side walls 86 of microchannel 80 so that the side walls converge from inlet chamber 72 to outlet chamber 76, and drafts the bottom wall 87 so that it converges from inlet chamber 72 to outlet chamber 76. Top wall 88, shown undrafted in FIGS. 10 to 12, can also be drafted so that it converges from inlet chamber 72 to outlet chamber 76. In different embodiments, one or more of the side walls 86, bottom wall 87 and top wall 88 can constantly converge from inlet chamber 72 to outlet chamber 76, or can converge on only part of the length of microchannel 80. In different embodiments, the draft angle of side walls 86, bottom wall 87 and top wall 88 can be between 1 degree and 30 degrees. In other embodiments, the microchannel 80 can be sloped (downward or upward) with respect to the inlet chamber 72 and outlet chamber 76, and/or the microchannel entrance 83 can be located a distance above or below the microchannel exit 85, which helps eliminate the sharp 90 degree turn into the microchannel entrance 83 and out of the microchannel exit 85. It has been determined that interaction chamber 70 provides the highest fluid energy at the channel exit for a given dimension.

Figure 13:
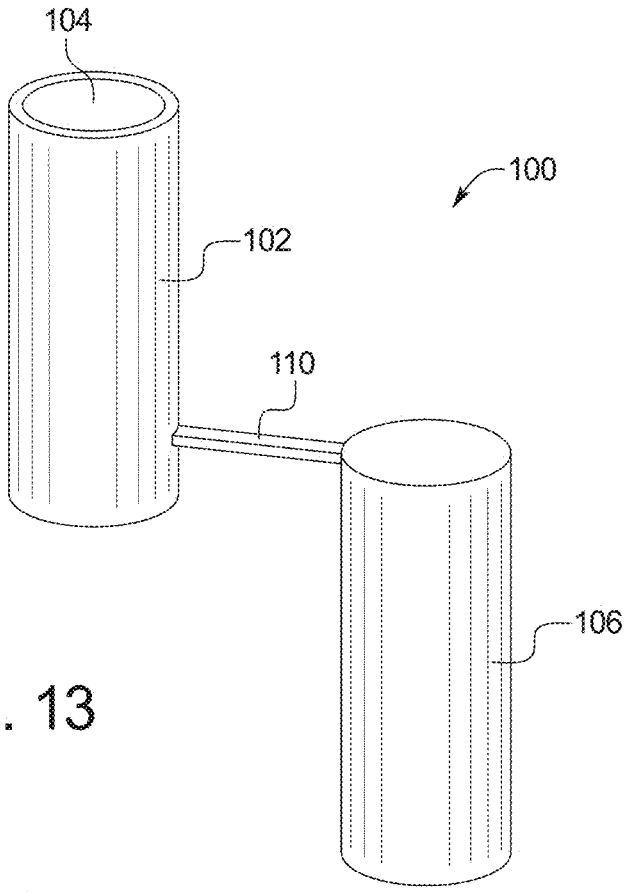
FIG. 13 depicts a top perspective view of an example embodiment of an interaction chamber.
Figure 14:
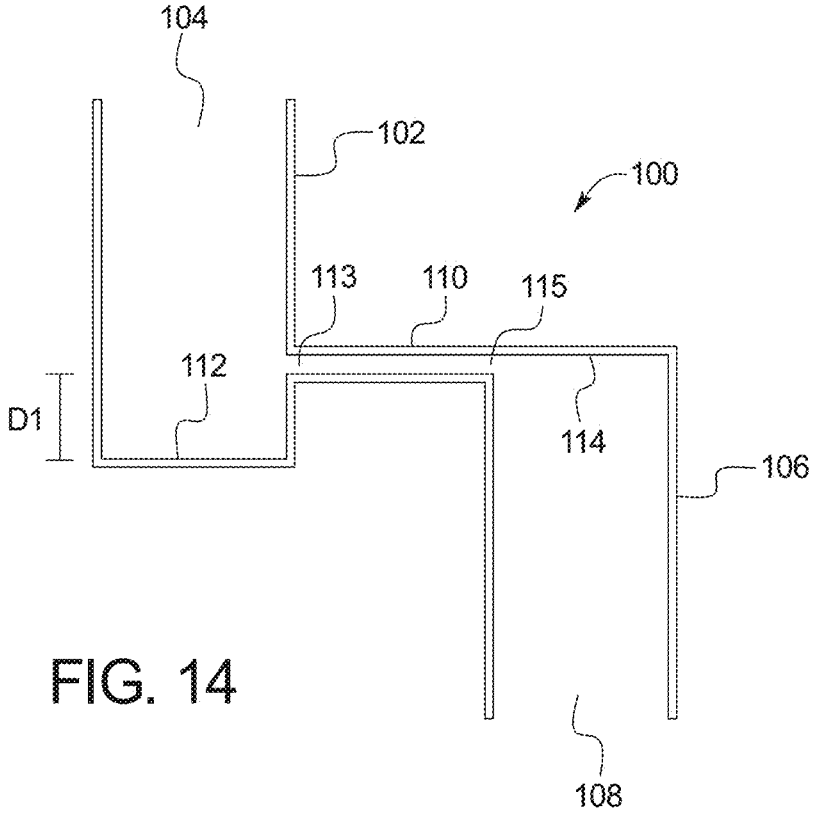
FIG. 14 depicts a side cross-sectional view of the interaction chamber of FIG. 13.

FIGS. 13 and 14 show another example embodiment of the working section of an improved H-type interaction chamber 100 according to the present disclosure. Interaction chamber 100 includes an inlet chamber 102 with an inlet hole 104, an outlet chamber 106 with an outlet hole 108, and a microchannel 110 joining inlet chamber 102 to outlet chamber 106 and placing inlet hole 104 in fluid communication with outlet hole 108. Inlet chamber 102 and outlet chamber 106 are preferably cylinders. Microchannel 110 includes a microchannel entrance 113 where microchannel 110 meets inlet chamber 102 and a microchannel exit 115 where microchannel 110 meets outlet chamber 106. As illustrated, microchannel 110 is located a distance D1 from bottom end 112 of inlet chamber 102. In an embodiment, D1 can be in the range of 0.001 to 1 inch, or preferably 0.01 to 0.03 inches. Microchannel 110 can also be formed a distance from top end 114 of outlet chamber 106.

Figure 15:
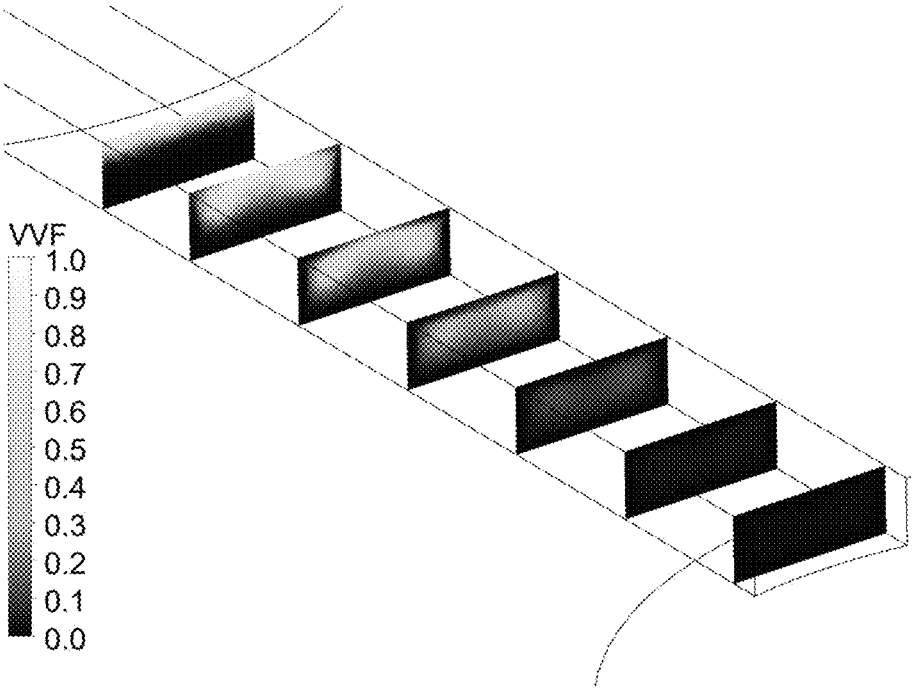
FIG. 15 depicts a diagram of the cavitation effect of the interaction chamber of FIG. 1.
Figure 16:
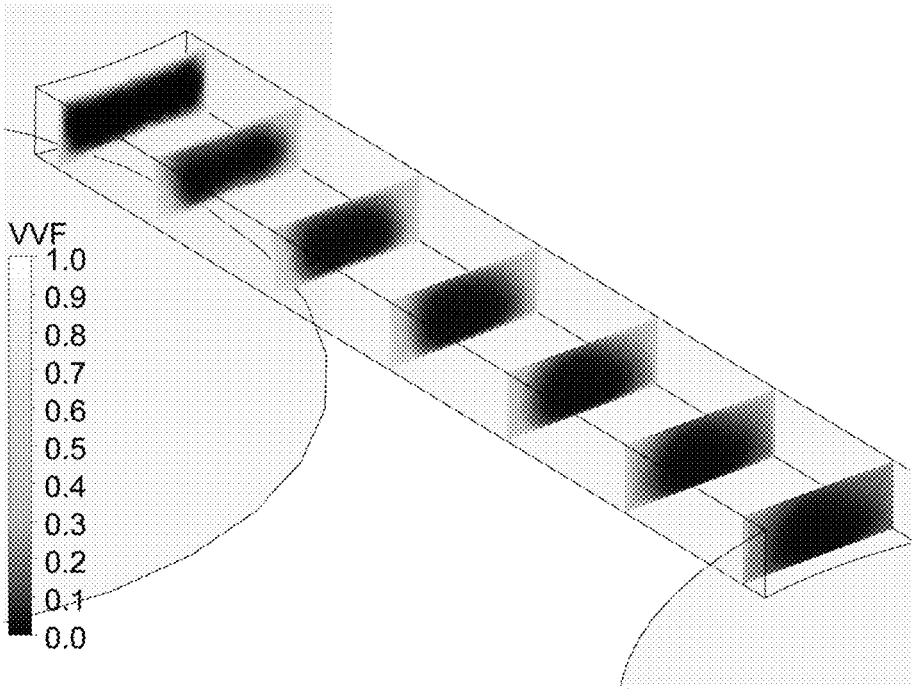
FIG. 16 depicts a diagram of the cavitation effect of the interaction chamber of FIG. 14.

FIGS. 15 and 16 are cavitation diagrams for interaction chamber 1 and interaction chamber 100, respectively, using a computational fluid dynamics simulation. FIGS. 15 and 16 show the vapor volume fraction (VVF) inside the microchannels. Both chambers have essentially the same microchannel dimensions, but interaction chamber 100 reduces the channel entrance cavitation effect. Interaction chamber 100 can therefore reduce the material plugging at the channel entrance for some materials.

Figure 17:
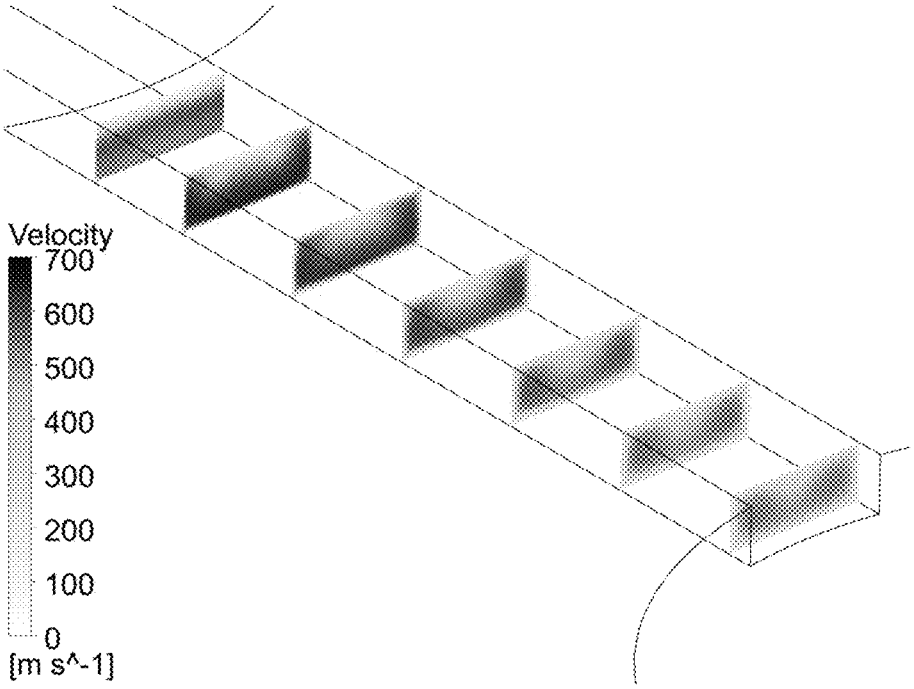
FIG. 17 depicts a diagram of the velocity distribution inside the interaction chamber of FIG. 1.
Figure 18:
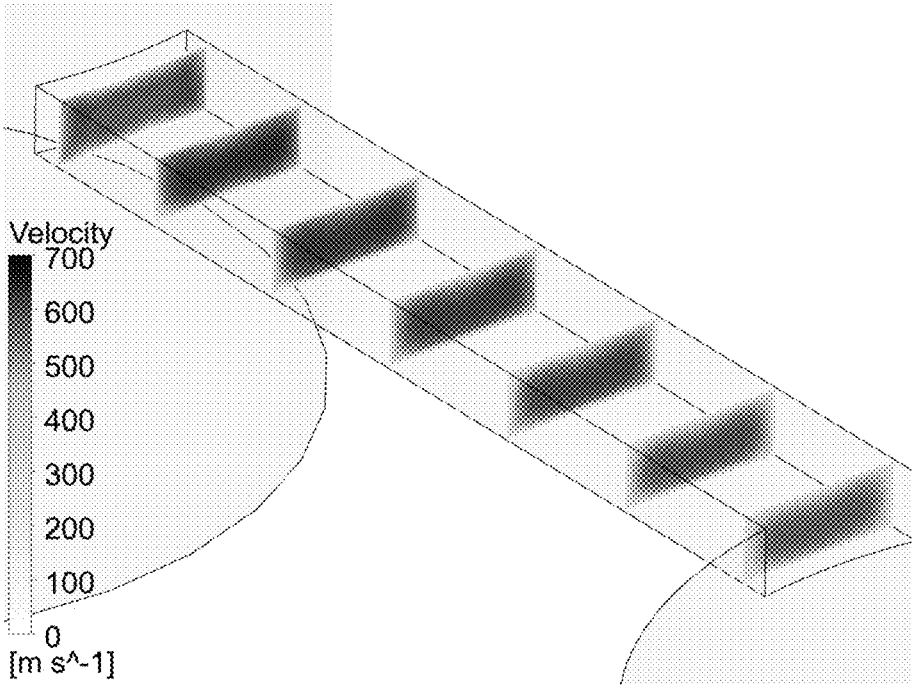
FIG. 18 depicts a diagram of the velocity distribution inside the interaction chamber of FIG. 14.

FIGS. 17 and 18 are velocity distribution diagrams for interaction chamber 1 (IXC-1) and interaction chamber 100 (IXC-100), respectively, using a computational fluid dynamics simulation. FIGS. 17 and 18 show a more uniform velocity inside the microchannel of interaction chamber 100 and a higher channel exit velocity for interaction chamber 100. Specifically, the average channel exit velocity for interaction chamber 100 is increased by approximately 11%. This means that the fluid through interaction chamber 100 can carry more kinetic energy for post-channel dissipation and potentially produce smaller particles for certain applications.

Interaction chamber 100 was tested in a lab with solid dispersions (plugging test) and three different emulsion formulations. The plugging test results are shown in Table 1, and the emulsion results are shown in Tables 2, 3 and 4. The three dispersions were created by dispersing soybean meal in water. Dispersion 1 was a 5% soybean meal suspension, Dispersion 2 was a 5.5% soybean meal suspension, and Dispersion 3 was a 6% soybean meal suspension.

TABLE 1

Plugging Test Results

| | | Number of Plugging Occurrences | |
|---|---|---|---|
| Material | Test No. | Interaction Chamber 1 | Interaction Chamber 100 |
| 5% Soybean meal suspension | 1 | 1 Partial | None |
| 5.5% Soybean meal Suspension | 1 | 1 Complete | 1 Complete |
| | 2 | 1 Partial | None |
| | 3 | 2 Partial | None |
| 6% Soybean meal Suspension | 1 | 3 Complete | 2 Complete |

In Table 1, the number of plugging occurrences during the course of each experiment for each emulsion is shown for both interaction chamber 1 and interaction chamber 100. A "partial" plugging means that the machine was plugged but able to complete its stroke. A "complete" plugging means that the piston was unable to continue pushing fluid through the interaction chamber. As shown above, interaction chamber 100 eliminated partial pluggings and reduced complete pluggings as compared to interaction chamber 1. Table 1 shows that interaction chamber 100 can reduce or eliminate plugging at certain conditions which could plug the exiting chambers of interaction chamber 1 with the same microchannel dimensions.

In the following tables, different interaction chambers were tested in both a forward and a reverse configuration. It should be understood that the reverse configuration turns the inlet chamber into an outlet chamber and the outlet chamber into an inlet chamber. Thus, the reverse testing performed herein is essentially a test of an additional embodiment of an interaction chamber that positions the inlet, outlet and microchannel(s) in opposite configurations. It is contemplated that any of the interaction chamber embodiments described herein can also be configured in the reverse configuration, wherein the inlet chamber is an outlet chamber and the outlet chamber is an inlet chamber.

TABLE 2

| Emulsion Formulation 1 Test Results | | | | | |
|---|---|---|---|---|---|
| Chamber | Pressure (kpsi) | Z-Ave (d · nm) 1st Pass | PDI 1st Pass | Z-Ave (d · nm) 2nd Pass | PDI 2nd Pass |
| IXC-1 | 20 | 177.4 | 0.149 | 163.4 | 0.088 |
| IXC-100 (Forward) | 20 | 168.8 | 0.143 | 154.5 | 0.112 |
| IXC-100 (Reverse) | 20 | 170.8 | 0.15 | 153.8 | 0.115 |

Table 2 shows the average particle size and the polydispersity index ("PDI") for each of interaction chamber 1 and interaction chamber 100 during the experiments. As shown, interaction chamber 100 causes the particle size to diminish as compared to interaction chamber 1. Table 2 shows that interaction chamber 100 has slightly better emulsion performance for emulsion formulation 1 compared to interaction chamber 1, either running in the forward or reverse directions. The Z-average size is about 10 nm smaller for both the first and second pass.

TABLE 3

| Emulsion Formulation 2 Test Results | | | | | | |
|---|---|---|---|---|---|---|
| Chamber | Pressure (kpsi) | # Pass | D10 (nm) | D50 (nm) | D90 (nm) | D95 (nm) |
| IXC-1 | 20 | 1 | 107.3 | 195.4 | 781.5 | 1658.1 |
| | | 2 | 107.2 | 192.2 | 337.7 | 463.2 |
| IXC-100 (Forward) | 20 | 1 | 103.2 | 184.4 | 388.9 | 1301.8 |
| | | 2 | 103.3 | 180.9 | 299.6 | 356.9 |
| IXC-100 (Reverse) | 20 | 1 | 95.7 | 166.0 | 289.6 | 411.1 |
| | | 2 | 94.4 | 159.8 | 252.3 | 285.6 |
| Y-Chamber 1 | 20 | 1 | 100.0 | 177.0 | 323.9 | 546.7 |
| | | 2 | 96.8 | 166.6 | 267.5 | 303.1 |
| Y-Chamber 2 | 20 | 1 | 87.3 | 146.3 | 237.3 | 275.5 |
| | | 2 | 86.6 | 141.5 | 217.9 | 244.9 |

Table 3 shows the diameters of the particles that lie below 10% (D10), 50% (D50), 90% (D90) and 95% (D95) of the volume based distributions during experiments with both interaction chamber 1 and interaction chamber 100 (in forward and reverse), as well as two different Y-type interaction chambers (e.g., FIG. 43). That is, D10 refers to the diameter that 10% of the particles are below this size, D50 refers to the diameter that 50% of the particles are below this size, D90 refers to the diameter that 90% of the particles are below this size, and D95 refers to the diameter that 95% of the particles are below this size. As shown above, the results at 95% are much more distinctive than the results at 10%.

Interaction chamber 100 was compared to Y-Chamber 1 and Y-Chamber 2, which are two Y-chambers with downstream APM and differently sized microchannels. The microchannels of Y-Chamber 2 had a larger cross-sectional area than the microchannels of Y-Chamber 1. Y-chambers, as well as Z-chambers, are useful for processing emulsions. In this instance, the Y-chambers are used in this instance for comparison purposes. Table 3 shows that interaction chamber 100 provides better emulsion results for emulsion formulation 2. Table 3 also shows that interaction chamber 100 outperformed Y-Chamber 1 for both the first and second passes.

Figure 19:
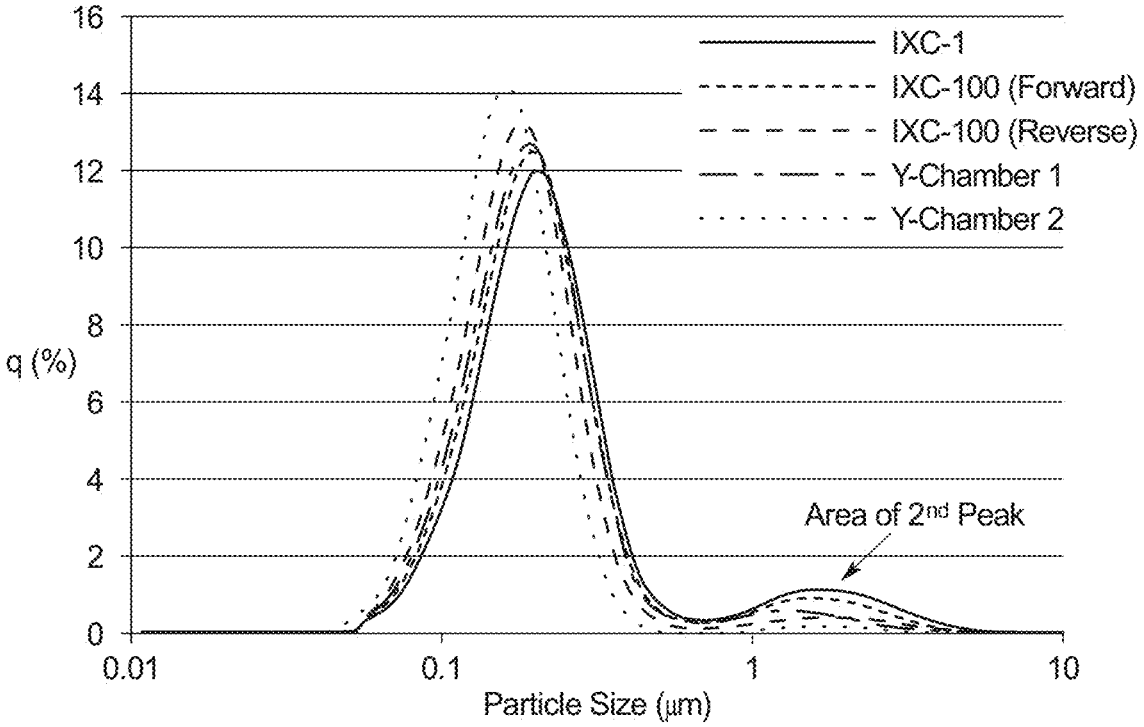
FIG. 19 depicts a diagram of particle size distribution.
Figure 20:
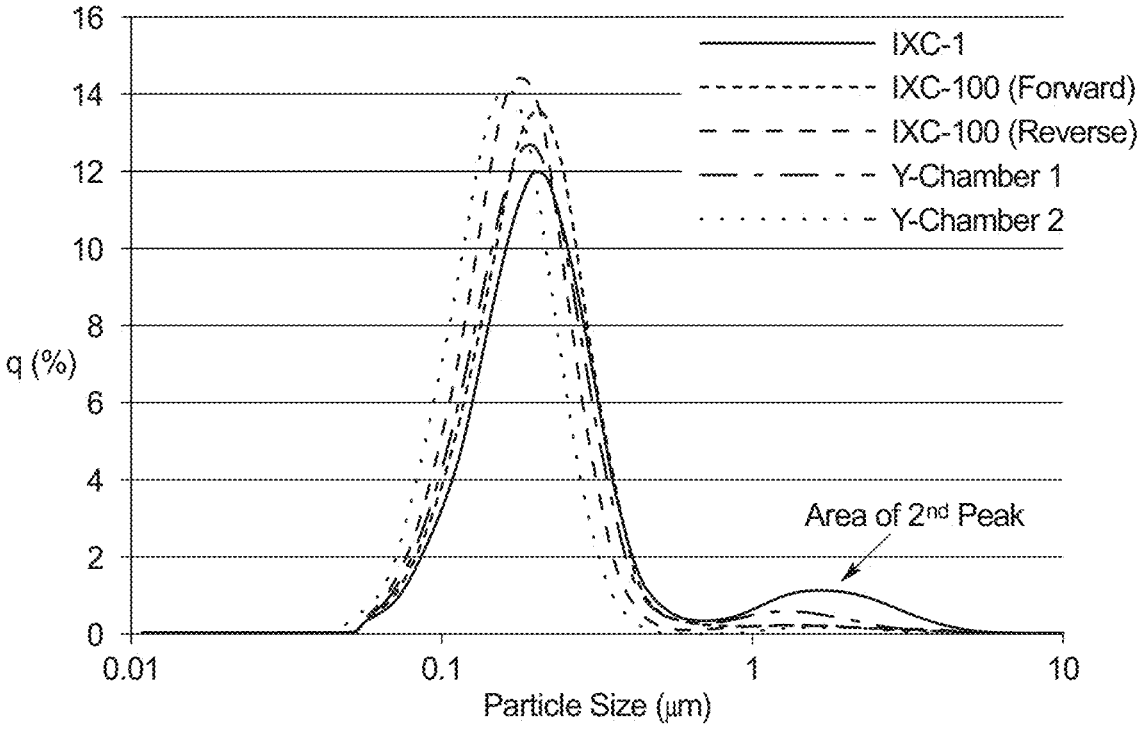
FIG. 20 depicts a diagram of particle size distribution.

FIGS. 19 and 20 show the particle size distribution for the chambers of Table 3 after one pass (FIG. 19) and two passes (FIG. 20). FIGS. 19 and 20 indicate that the particle size distributions are bimodal for all results after the first pass as well as a couple of the results after the second pass. The second peak represents the larger particles that remain in the processed samples, which are often the cause of emulsion instabilities and plugging of the filters during post processing sterile filtrations. One goal of the emulsification process is to reduce/remove the presence of large particles. As indicated in FIG. 20 after the second pass, the second peak still exists for interaction chamber 1. With interaction chamber 100, the second peak is either greatly reduced or completely eliminated Interaction chamber 100 running in reverse also outperformed the Y-type chambers under the process formulation and conditions.

TABLE 4

| Emulsion Formulation 3 Test Results | | | | | | |
|---|---|---|---|---|---|---|
| Chamber | Pressure (kpsi) | # Pass | D10 (nm) | D50 (nm) | D90 (nm) | D95 (nm) |
| IXC-1 | 20 | 1 | 174.9 | 270.2 | 378.2 | 417.2 |
| | | 2 | 173.4 | 262.8 | 365.1 | 399.4 |
| IXC-100 (Forward) | 20 | 1 | 181.2 | 279.4 | 387.4 | 428.1 |
| | | 2 | 133.3 | 219.9 | 322.0 | 351.9 |
| IXC-100 (Reverse) | 20 | 1 | 178.5 | 275.9 | 384.4 | 424.8 |
| | | 2 | 171.0 | 259.9 | 361.5 | 394.7 |
| Y-Chamber 1 | 20 | 1 | 179.2 | 283.1 | 400.8 | 439.5 |
| | | 2 | 176.8 | 271.0 | 373.9 | 414.5 |
| Y-Chamber 2 | 20 | 1 | 180.7 | 279.2 | 387.5 | 428.6 |
| | | 2 | 176.6 | 268.4 | 372.0 | 408.3 |

Similar to Table 3, Table 4 shows the diameters of the particles that lie below 10% (D10), 50% (D50), 90% (D90) and 95% (D95) of the volume based distribution during experiments with both interaction chamber 1 and interaction chamber 100 (in forward and reverse), as well as two different Y-type interaction chambers. Table 4 shows that the emulsion produced by interaction chamber 100 with the reverse configuration is similar to interaction chamber 1 for emulsion formulation 3. The resulting particle size, however, is much smaller when running in the forward configuration. The particle sizes for interaction chamber 100 are about 40 nm to 90 nm smaller than for interaction chamber 1 or the Y-type chambers after the second pass.

Figure 21:
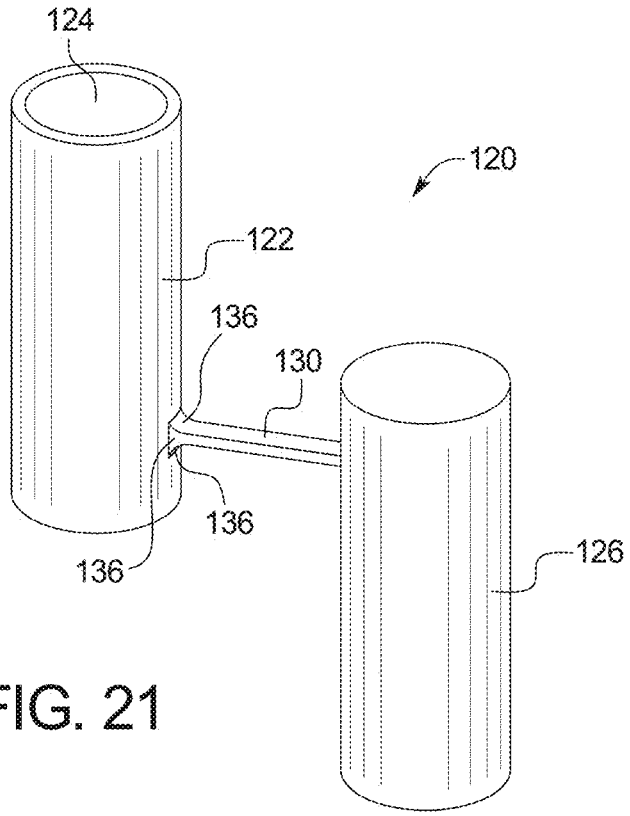
FIG. 21 depicts a top perspective view of an example embodiment of an interaction chamber.
Figure 22:
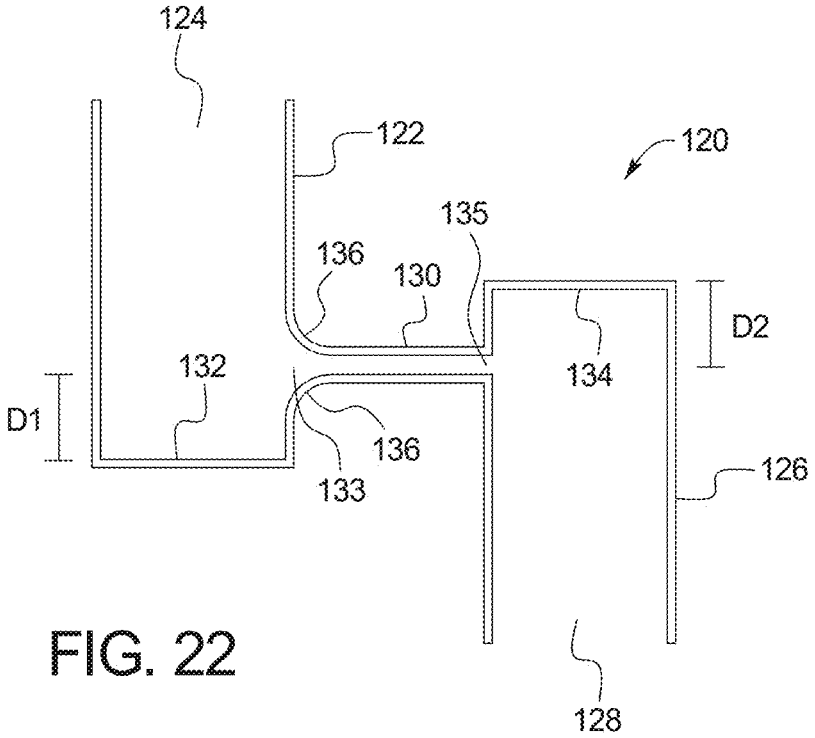
FIG. 22 depicts a side cross-sectional view of the interaction chamber of FIG. 21.

FIGS. 21 and 22 show another example embodiment of the working section of an improved H-type interaction chamber 120 according to the present disclosure. Interaction chamber 120 includes an inlet chamber 122 with an inlet hole 124, an outlet chamber 126 with an outlet hole 128, and a microchannel 130 joining inlet chamber 122 to outlet chamber 126 and placing inlet hole 124 in fluid communication with outlet hole 128. Inlet chamber 122 and outlet chamber 126 are preferably cylinders. Microchannel 130 includes a microchannel entrance 133 where microchannel 130 meets inlet chamber 122 and a microchannel exit 135 where microchannel 130 meets outlet chamber 126. As illustrated, microchannel 130 is located a distance D1 from bottom end 132 of inlet chamber 122 and a distance D2 from top end 134 of outlet chamber 126. D1 and D2 can be the same or different dimensions. Interaction chamber 120 further removes the sharp edges around the microchannel entrance 133 by adding round fillets 136 at the top, bottom and sides of microchannel entrance 133. This design is intended to further reduce or eliminate micro channel entrance cavitation effect and streamline the flow by adding a chamfer or fillet at the channel entrance. Round fillets can also be added at one or more of the sides of microchannel exit 135.

Figure 23:
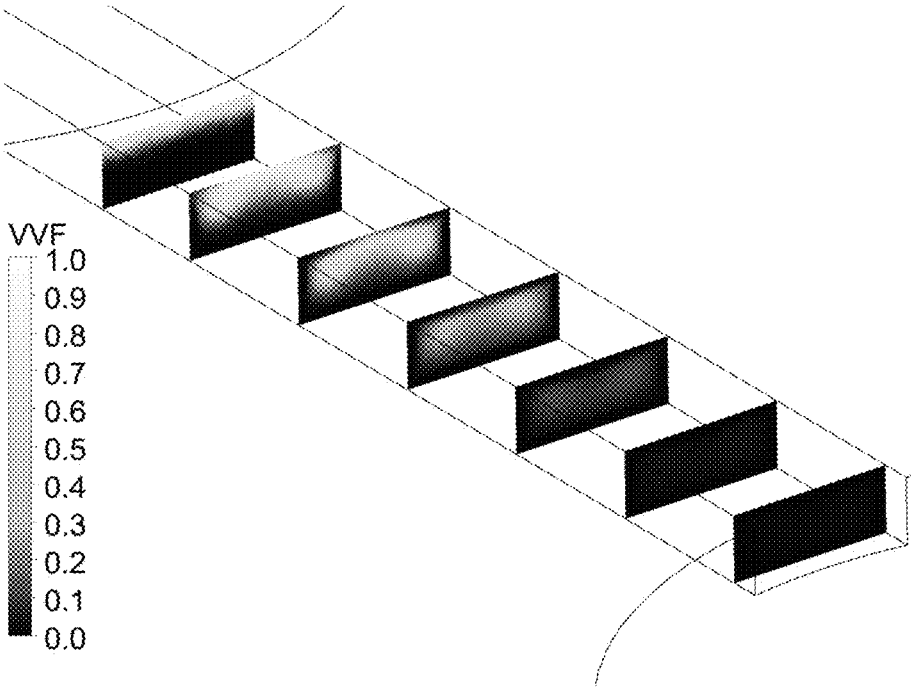
FIG. 23 depicts a diagram of the cavitation effect of the interaction chamber of FIG. 1.
Figure 24:
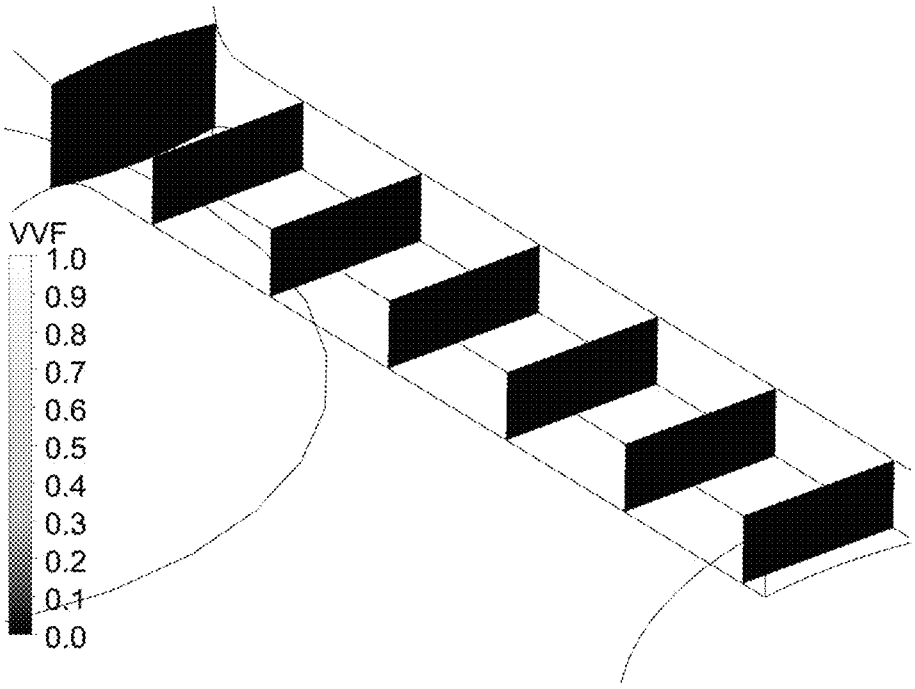
FIG. 24 depicts a diagram of the cavitation effect of the interaction chamber of FIG. 21.

FIGS. 23 and 24 are cavitation diagrams for interaction chamber 1 and interaction chamber 120, respectively, using a computational fluid dynamics simulation. FIGS. 23 and 24 show the vapor volume fraction inside the microchannels. Both chambers have essentially the same microchannel dimensions, but interaction chamber 120 completely eliminates the channel entrance cavitation effect. Interaction chamber 120 can therefore reduce the material plugging at the channel entrance for some materials.

Figure 25:
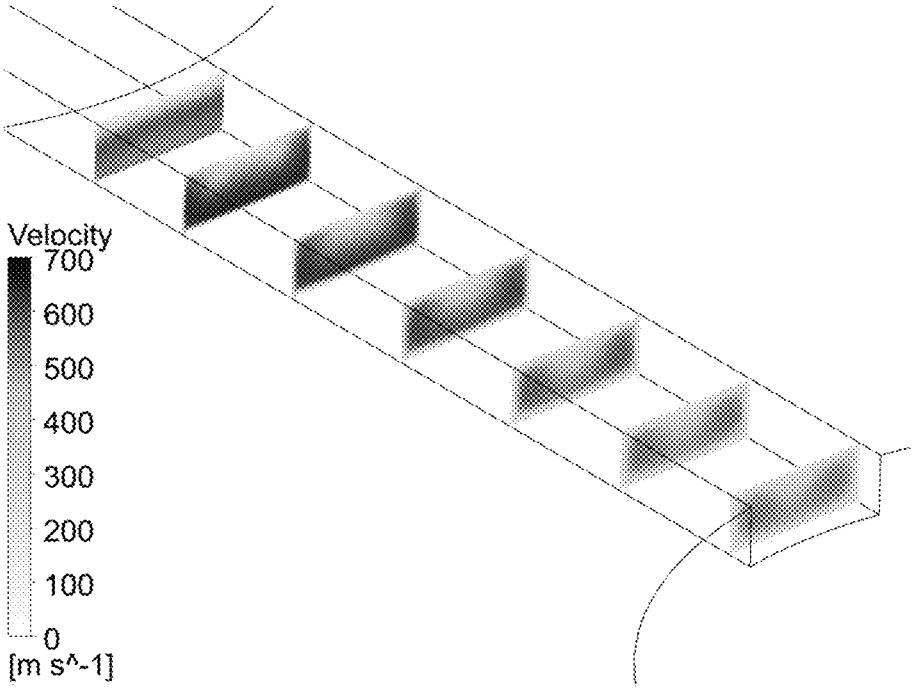
FIG. 25 depicts a diagram of the velocity distribution inside the interaction chamber of FIG. 1.
Figure 26:
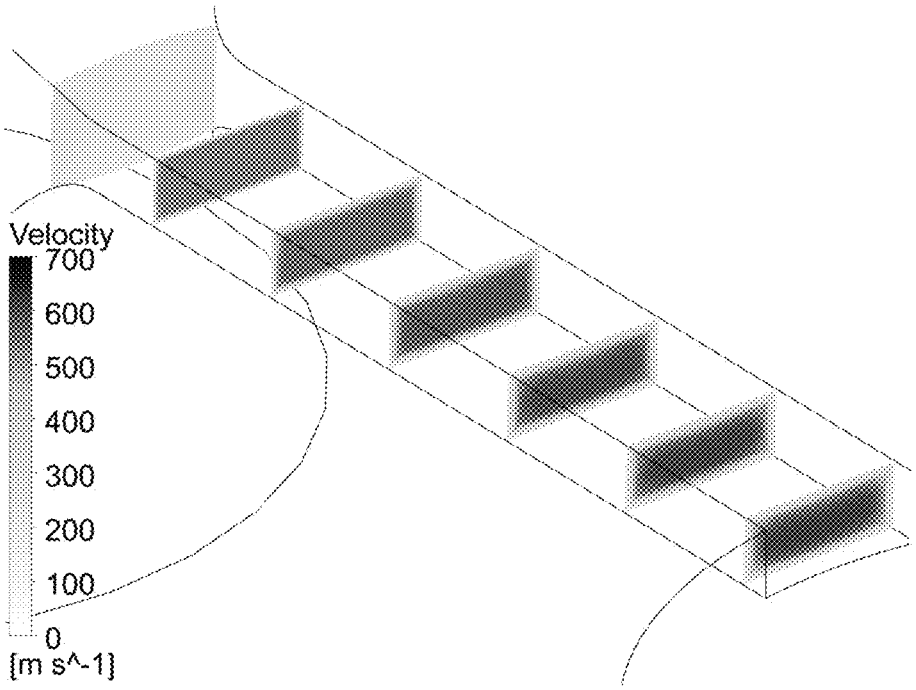
FIG. 26 depicts a diagram of the velocity distribution inside the interaction chamber of FIG. 21.

FIGS. 25 and 26 are velocity distribution diagrams for interaction chamber 1 and interaction chamber 120, respectively, using a computational fluid dynamics simulation. FIGS. 25 and 26 show a more uniform velocity inside the microchannel of interaction chamber 120 and a higher channel exit velocity for interaction chamber 120. Specifically, the average channel exit velocity for interaction chamber 120 is increased by approximately 10%. This means that the fluid through interaction chamber 120 can carry more kinetic energy for post-channel dissipation and potentially produce smaller particles for certain applications. Another benefit associated with the elimination of the cavitation effect is the reduction of the peak temperature associated with cavitation near the microchannel entrance. The maximum prediction temperature inside the channel is significantly reduced by about 17° C. from 85° C. to 68° C.

Interaction chamber 50 (IXC-50) was tested in a lab with three different emulsion formulations. Tables 5 to 7 shows the emulsion results for interaction chamber 50 as compared to interaction chamber 1.

TABLE 5

Emulsion Formulation 1 Test Results

| Chamber | Pressure (kpsi) | Z-Ave (d · nm) 1st Pass | PDI | Z-Ave (d · nm) 2nd Pass | PDI |
|---|---|---|---|---|---|
| IXC-1 | 20 | 177.4 | 0.149 | 163.4 | 0.088 |
| IXC-50 (Forward) | 20 | 170.0 | 0.144 | 156.7 | 0.110 |
| IXC-50 (Reverse) | 20 | 170.9 | 0.113 | 153.8 | 0.107 |

TABLE 6

Emulsion Formulation 2 Test Results

| Chamber | Pressure (kpsi) | # Pass | D10 (nm) | D50 (nm) | D90 (nm) | D95 (nm) |
|---|---|---|---|---|---|---|
| IXC-1 | 20 | 1 | 107.3 | 195.4 | 781.5 | 1658.1 |
| | | 2 | 107.2 | 192.2 | 337.7 | 463.2 |
| IXC-50 | 20 | 1 | 100.7 | 178.1 | 341.4 | 1073.8 |
| (Forward) | | 2 | 98.3 | 169.6 | 274.3 | 312.9 |
| IXC-50 | 20 | 1 | 98.1 | 171.8 | 306.7 | 486.1 |
| (Reverse) | | 2 | 95.7 | 163.1 | 257.6 | 291.9 |
| Y-Chamber | 20 | 1 | 100.0 | 177.0 | 323.9 | 546.7 |
| 1 | | 2 | 96.8 | 166.6 | 267.5 | 303.1 |
| Y-Chamber | 20 | 1 | 87.3 | 146.3 | 237.3 | 275.5 |
| 2 | | 2 | 86.6 | 141.5 | 217.9 | 244.9 |

TABLE 7

Emulsion Formulation 3 Test Results

| Chamber | Pressure (kpsi) | # Pass | D10 (nm) | D50 (nm) | D90 (nm) | D95 (nm) |
|---|---|---|---|---|---|---|
| IXC-1 | 20 | 1 | 174.9 | 270.2 | 378.2 | 417.2 |
| | | 2 | 173.4 | 262.8 | 365.1 | 399.4 |
| IXC-50 | 20 | 1 | 172.6 | 267.9 | 377.1 | 416.2 |
| (Forward) | | 2 | 127.7 | 209.8 | 308.1 | 335.8 |
| IXC-50 | 20 | 1 | 178.8 | 273.7 | 379.6 | 417.9 |
| (Reverse) | | 2 | 175.7 | 264.7 | 365.6 | 400.0 |

TABLE 7-continued

Emulsion Formulation 3 Test Results

| Chamber | Pressure (kpsi) | # Pass | D10 (nm) | D50 (nm) | D90 (nm) | D95 (nm) |
|---|---|---|---|---|---|---|
| Y-Chamber | 20 | 1 | 179.2 | 283.1 | 400.8 | 439.5 |
| 1 | | 2 | 176.8 | 271.0 | 373.9 | 414.5 |
| Y-Chamber | 20 | 1 | 180.7 | 279.2 | 387.5 | 428.6 |
| 2 | | 2 | 176.6 | 268.4 | 372.0 | 408.3 |

Table 5 shows the average particle size and the polydispersity index ("PDI") for each of interaction chamber 1 and interaction chamber 50 during the experiments. Tables 6 and 7 show the diameters of the particles that lie below 10% (D10), 50% (D50), 90% (D90) and 95% (D95) of the volume based distribution during experiments. Table 5 shows that interaction chamber 50 has slightly better emulsion performance for emulsion formulation 1 as compared to interaction chamber 1. The Z-average size is about 7 to 10 nm smaller for the first pass and the second pass. Table 6 shows that interaction chamber 50 provides much better emulsion results for emulsion formulation 2 when running in both the forward and reverse configurations. D50 is about 20 nm and 30 nm smaller as compared to interaction chamber 1 for the first pass and the second pass, respectively. Table 6 also shows that interaction chamber 50 outperformed Y Chamber 1 for both the first and second passes. Table 7 shows that interaction chamber 50 provides much better emulsion results for emulsion formulation 3 when running in the forward configuration. The particle sizes for interaction chamber 50 are about 50 nm to 100 nm smaller than for interaction chamber 1 or the Y-type chambers after the second pass.

Figure 27:
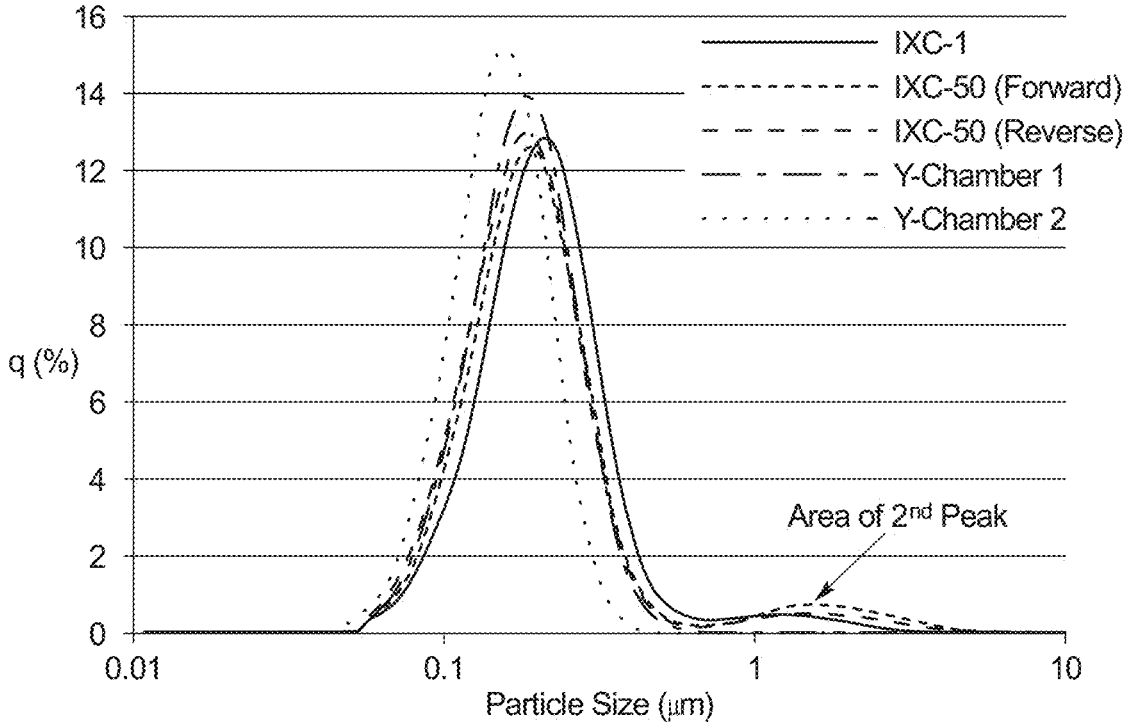
FIG. 27 depicts a diagram of particle size distribution.
Figure 28:
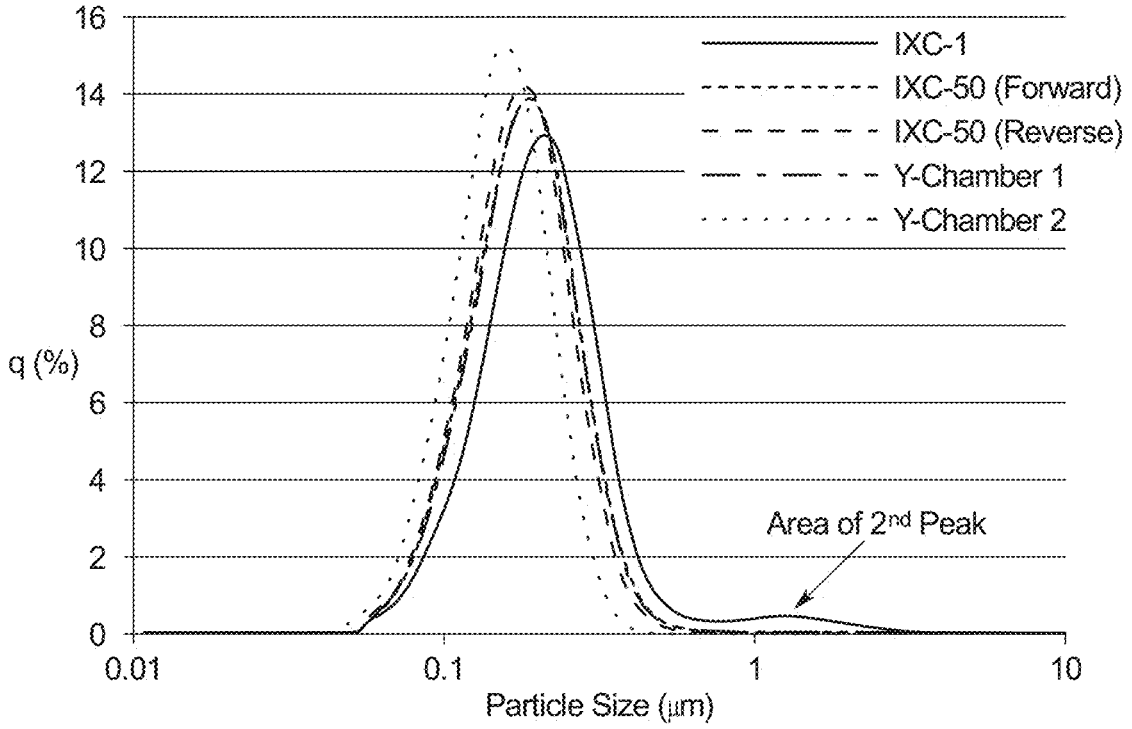
FIG. 28 depicts a diagram of particle size distribution.

FIGS. 27 and 28 show the particle size distribution for the chambers of Table 6 after one pass (FIG. 27) and two passes (FIG. 28). FIGS. 27 and 28 indicate that the particle size distributions are bimodal for all results after the first pass as well as a couple of the results after the second pass. The second peak represents the larger particles remaining in the processed samples, which are often the cause of emulsion instabilities. Thus, one goal of the emulsification process is to reduce/remove the presence of large particles. As indicated in FIG. 28 after the second pass, the second peak still exists for interaction chamber 1. With interaction chamber 50, the second peak is completely eliminated in both the forward and reverse configurations. Interaction chamber 50 running in reverse also outperformed Y Chamber 1 under the process formulation and conditions.

Figure 29:
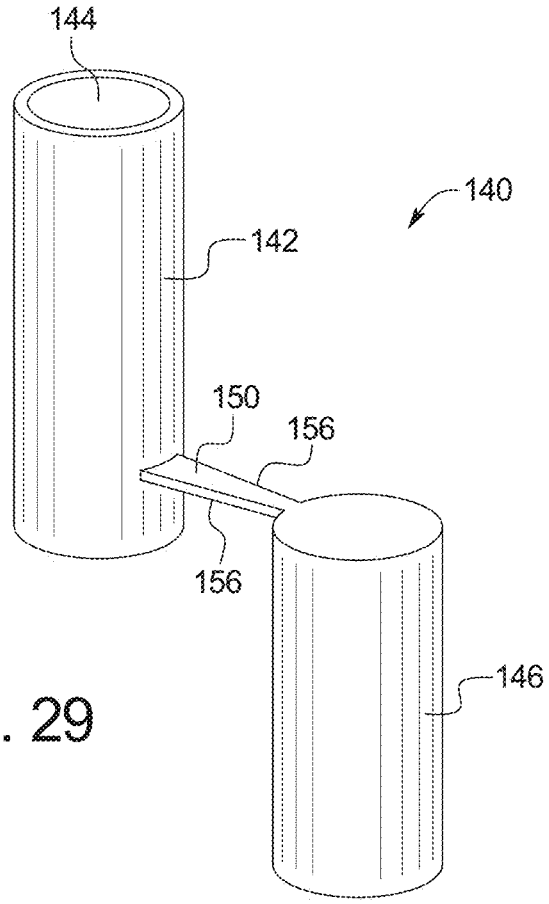
FIG. 29 depicts a top perspective view of an example embodiment of an interaction chamber.
Figure 30:
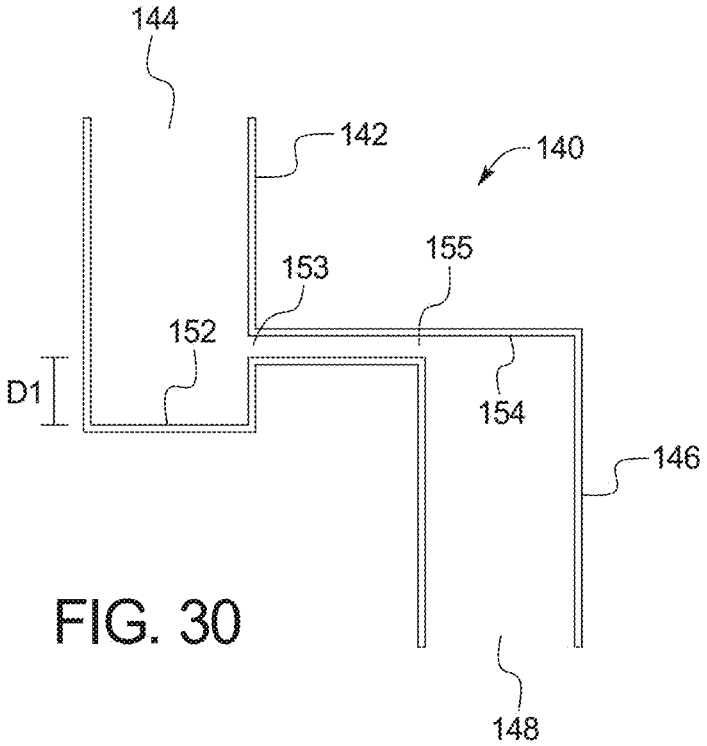
FIG. 30 depicts a side cross-sectional view of the interaction chamber of FIG. 29.
Figure 31:
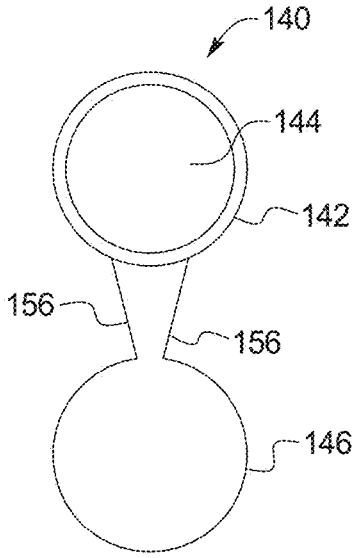
FIG. 31 depicts a top view of the interaction chamber of FIG. 29.

FIGS. 29 to 31 show another example embodiment of the working section of an improved H-type interaction chamber 140 according to the present disclosure. Interaction chamber 140 includes an inlet chamber 142 with an inlet hole 144, an outlet chamber 146 with an outlet hole 148, and a microchannel 150 joining inlet chamber 142 to outlet chamber 146 and placing inlet hole 144 in fluid communication with outlet hole 148. Inlet chamber 142 and outlet chamber 146 are preferably cylinders. Microchannel 150 includes a microchannel entrance 153 where microchannel 150 meets inlet chamber 142 and a microchannel exit 155 where microchannel 150 meets outlet chamber 146. Like microchannel 40, microchannel 150 is located a distance D1 from bottom end 152 of inlet chamber 142. Microchannel 150 can also be formed a distance from top end 154 of outlet chamber 146. Interaction chamber 140 further drafts the side walls 156 of microchannel 150 so that the side walls 156 converge from inlet chamber 142 to outlet chamber 146. In different embodiments, the side walls 156 can constantly converge from inlet chamber 142 to outlet chamber 146, or the side walls 156 can converge on only part of the length of microchannel 150. In different embodiments, the draft can be added to all four channel surfaces, a pair of channel surfaces (either top and bottom or left and right), or a single channel surface. In different embodiments, the draft angle of side walls 156 and/or the top and/or bottom wall can be between 1 degree and 30 degrees. When adding the draft to the channel surface(s), the cross-sectional area and dimensions at the channel exit are preferably kept the same. That is, if modifying an existing interaction chamber, it is preferable to keep the microchannel exit at the same cross-sectional dimension and increase the cross-section at the microchannel entrance.

Figure 32:
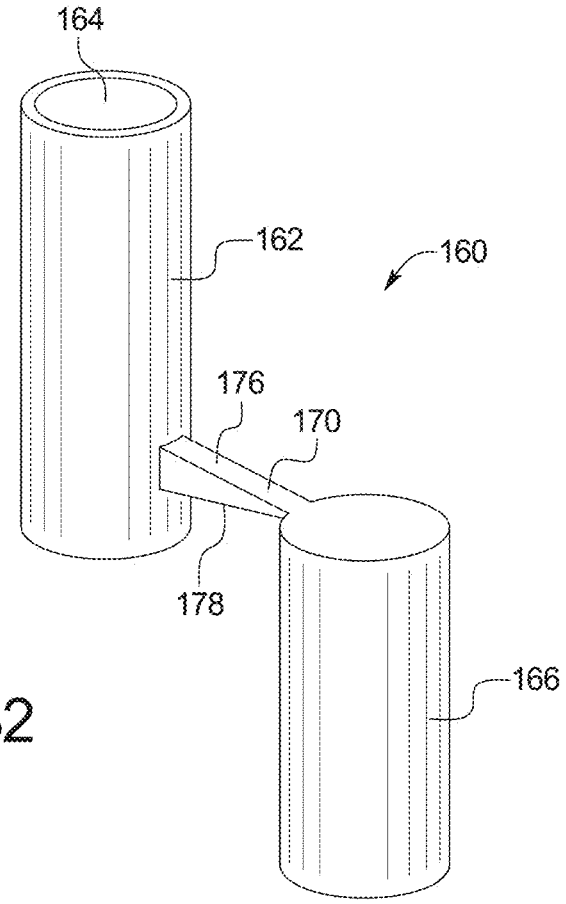
FIG. 32 depicts a top perspective view of an example embodiment of an interaction chamber.
Figure 33:
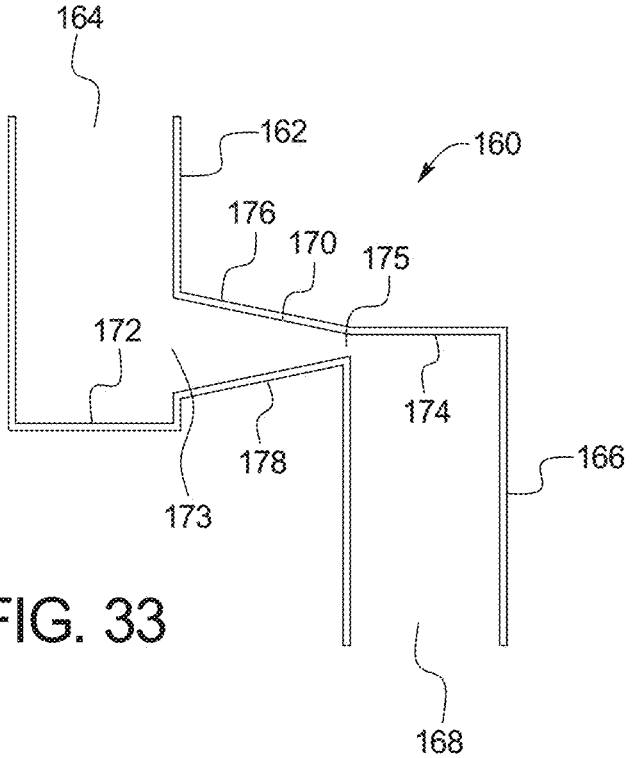
FIG. 33 depicts a side cross-sectional view of the interaction chamber of FIG. 32.
Figure 34:
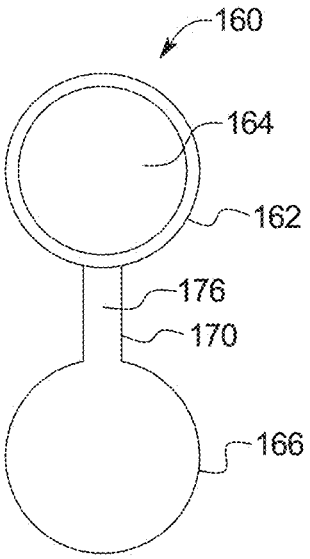
FIG. 34 depicts a top view of the interaction chamber of FIG. 32.

FIGS. 32 to 34 show another example embodiment of the working section of an improved H-type interaction chamber 160 according to the present disclosure. Interaction chamber 160 includes an inlet chamber 162 with an inlet hole 164, an outlet chamber 166 with an outlet hole 168, and a microchannel 170 joining inlet chamber 162 to outlet chamber 166 and placing inlet hole 164 in fluid communication with outlet hole 168. Inlet chamber 162 and outlet chamber 166 are preferably cylinders. Microchannel 170 includes a microchannel entrance 173 where microchannel 170 meets inlet chamber 162 and a microchannel exit 175 where microchannel 170 meets outlet chamber 166. Like microchannel 40, microchannel 170 is located a distance D1 from bottom end 172 of inlet chamber 162. Microchannel 170 can also be formed a distance from top end 174 of outlet chamber 166. Interaction chamber 160 further drafts the top wall 176 and bottom wall 178 of microchannel 170 so that the top and bottom walls converge from inlet chamber 162 to outlet chamber 166. In different embodiments, only one of the top and bottom wall can be drafted, or both the top and bottom wall can be drafted to be parallel so that the cross-sectional area at microchannel entrance 173 is the same as the cross-sectional area at microchannel exit 175.

Figure 35:
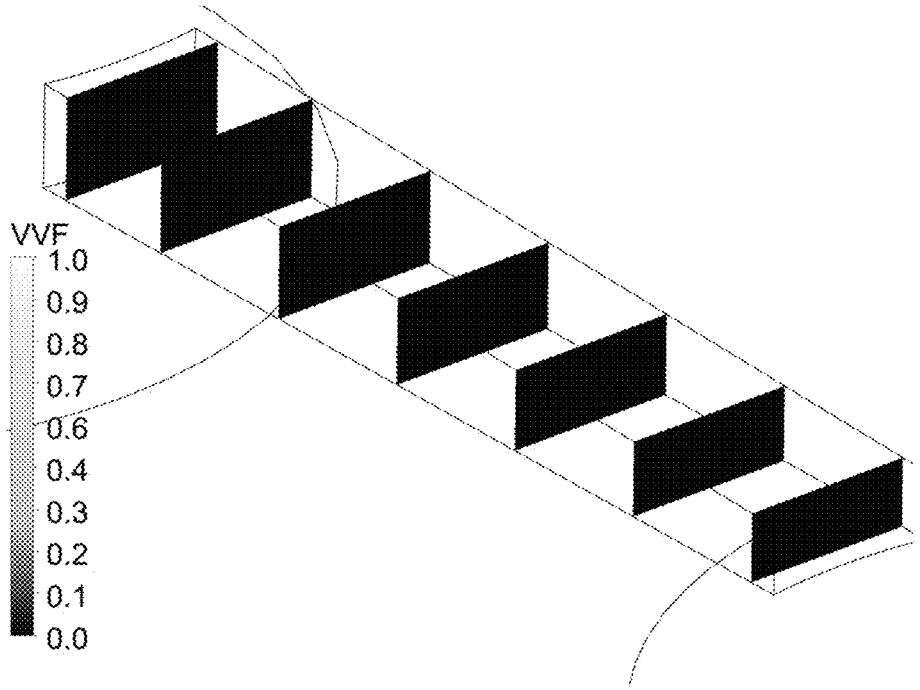
FIG. 35 depicts a diagram of the cavitation effect of the interaction chamber of FIG. 32.
Figure 36:
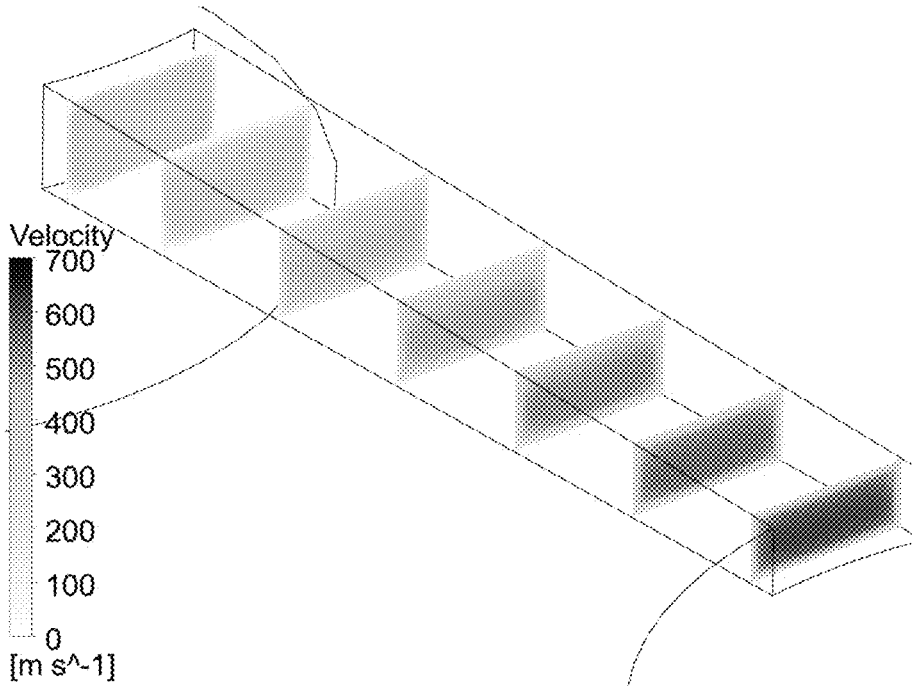
FIG. 36 depicts a diagram of the velocity distribution inside the interaction chamber of FIG. 32.

FIGS. 35 and 36 are a vapor volume fraction diagram and a velocity profile diagram, respectively, for interaction chamber 160 using a computational fluid dynamics simulation. As shown, interaction chamber 160 greatly eliminates the channel entrance cavitation effect. Interaction chamber 160 therefore reduces the material plugging at this location for some materials. Further, by adding the draft to the channel walls, maximum velocity is achieved at the microchannel exit. The predicted average channel exit velocity increases by approximately 21% for interaction chamber 160, which means the fluid carries much higher kinetic energy for dissipation and can lead to smaller particle size. It has been determined that interaction chambers 140 and 160 provide the highest fluid energy at the channel exit for a given dimension. Another benefit of reducing the cavitation effect is the reduction of the peak temperature associated with cavitation near the channel entrance. The maximum predicted temperature inside the channel is reduced significantly by about 14° C. from 84° C. to 70° C.

In alternative embodiments, any of the features of interaction chamber 30, interaction chamber 50, interaction chamber 70, interaction chamber 100, interaction chamber 120, interaction chamber 140 and interaction chamber 160 can be combined. For example, a microchannel can be made with one or more of converging walls, tapered fillets and a distance D1 between the microchannel and a bottom wall of an inlet chamber. The inlet chambers and outlet chambers can also be reversed in each embodiment, so that the inlet chambers shown in the figures are outlet chambers and the outlet chambers shown in the figures are inlet chambers. Further, these same concepts can be used with other types of interaction chambers, such as multi-slotted H-type interaction chambers and Y-type interaction chambers. In other embodiments, the microchannels can have different shapes, for example, the shape of a rectangle, square, trapezoid, triangle or circle. The microchannels can also be sloped (downward or upward) with respect to the inlet chambers and outlet chambers, and/or the microchannel entrances can be located a distance above or below the microchannel exits, which helps eliminate the sharp 90 degree turn into the microchannel entrances and out of the microchannel exits.

Figure 37:
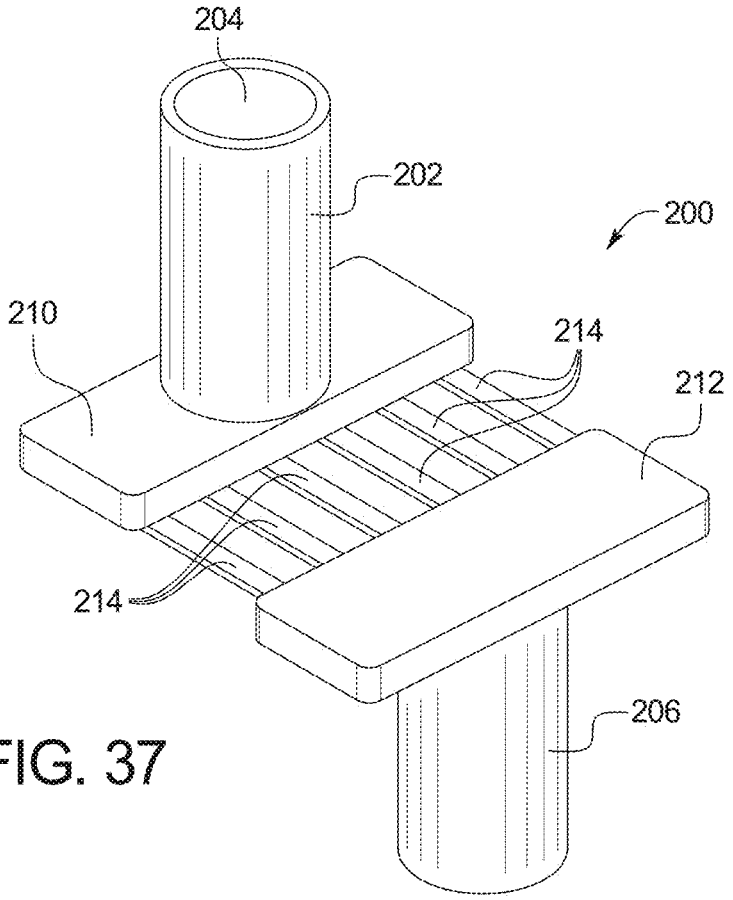
FIG. 37 depicts a top perspective view of an example embodiment of an interaction chamber.
Figure 38:
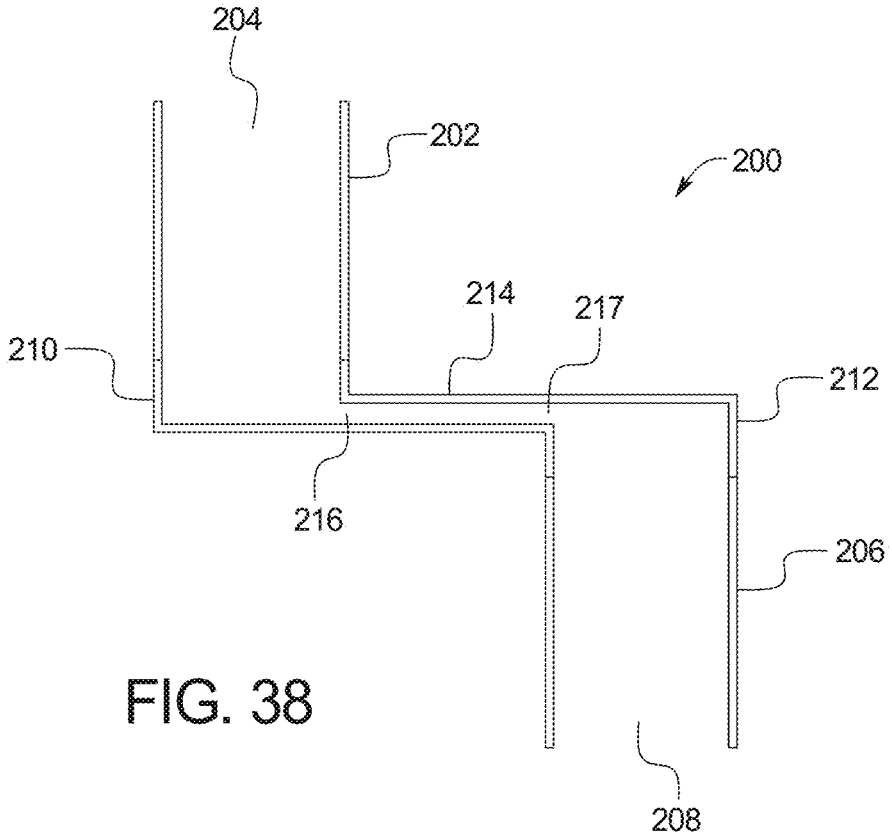
FIG. 38 depicts a side cross-sectional view of the interaction chamber of FIG. 37.

FIGS. 37 and 38 show an example embodiment of the working section of a multi-slotted interaction chamber 200. Interaction chamber 200 includes an inlet chamber 202 with an inlet hole 204, an outlet chamber 206 with an outlet hole 208, an inlet plenum 210 and an outlet plenum 212, and a plurality of microchannels 214 connecting the inlet plenum 210 to the outlet plenum 212. Inlet chamber 202 and outlet chamber 206 are preferably cylinders. Each microchannel 214 includes a microchannel entrance 216 where microchannel 214 meets inlet plenum 210 and a microchannel exit 217 where microchannel 214 meets outlet plenum 212. In use, incoming fluid enters inlet hole 204, passes through inlet chamber 202 and inlet plenum 210, and then enters the plurality of microchannels 214 at the microchannel entrances 216. The fluid then exits the plurality of microchannels 214 out of microchannel exits 217 and into outlet plenum 212, passes through outlet chamber 206, and exits through outlet hole 208.

Figure 39:
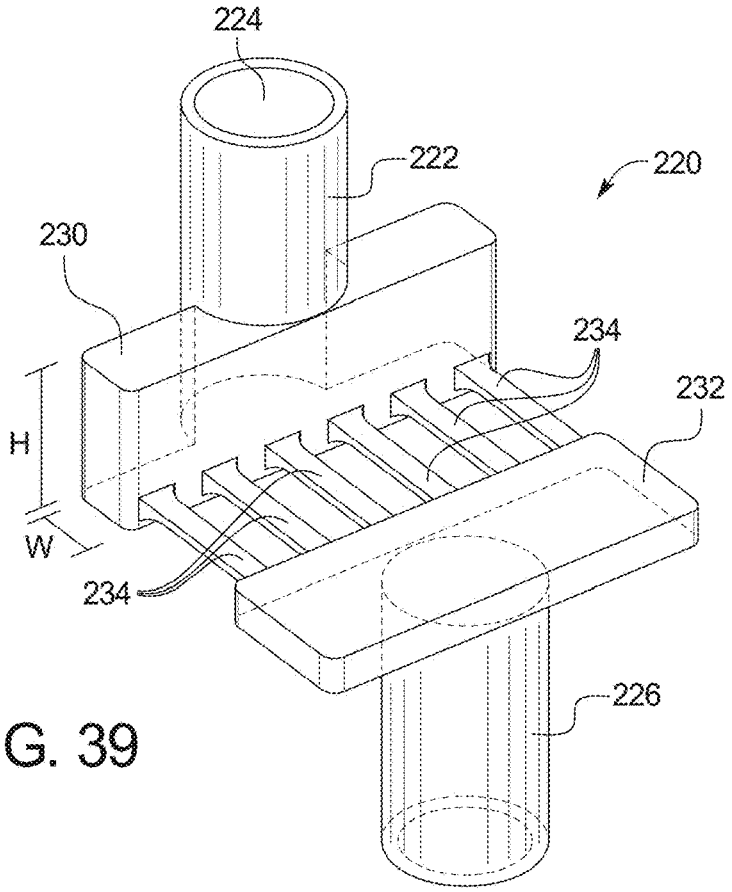
FIG. 39 depicts a top perspective view of an example embodiment of an interaction chamber.
Figure 40:
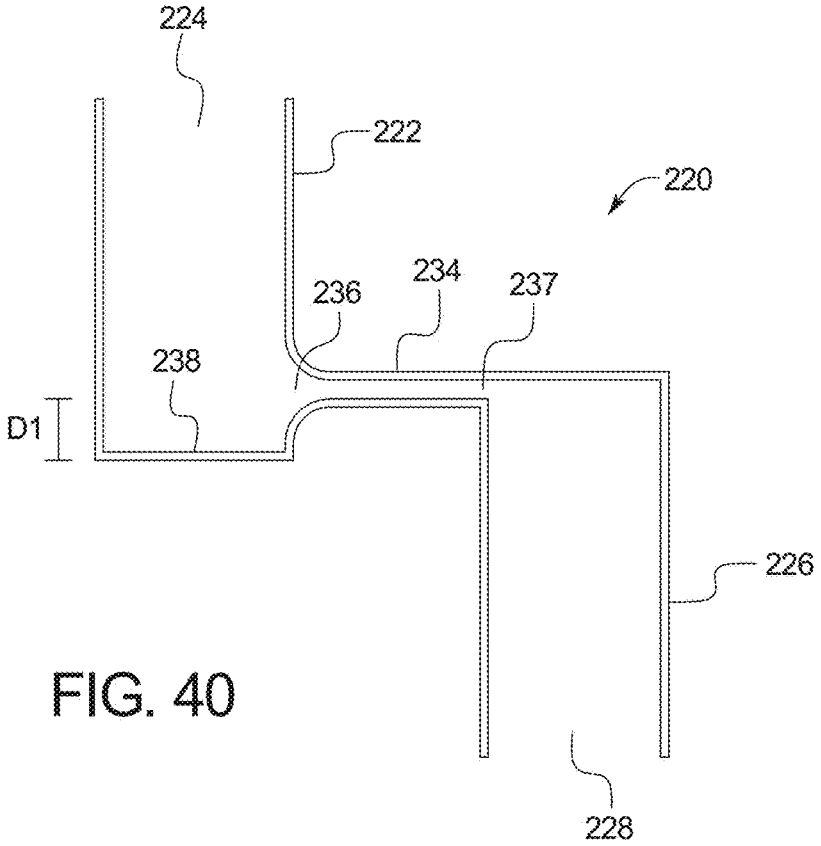
FIG. 40 depicts a side cross-sectional view of the interaction chamber of FIG. 39.

FIGS. 39 and 40 show an example embodiment of the working section of an improved multi-slotted interaction chamber 220 according to the present disclosure. Interaction chamber 220 includes an inlet chamber 222 with an inlet hole 224, an outlet chamber 226 with an outlet hole 228, an inlet plenum 230 and an outlet plenum 232, and a plurality of microchannels 234 connecting the inlet plenum 230 to the outlet plenum 232. Inlet chamber 222 and outlet chamber 226 are preferably cylinders. Each microchannel 234 includes a microchannel entrance 236 where microchannel 234 meets inlet plenum 230 and a microchannel exit 237 where microchannel 234 meets outlet plenum 232.

As illustrated in FIGS. 39 and 40, the width W of inlet plenum 230 has been reduced to be less than the diameter of inlet chamber 226, and the height H of inlet plenum 230 has been increased so the height H of inlet plenum 230 extends into, or interrupts the diameter of, inlet chamber 226. That is, inlet chamber 226 and inlet plenum 230 share a common bottom end 238, with a portion of the tapered diameter of inlet chamber 226 extending all the way down to bottom end 238 or close to bottom end 238. The microchannels 234 are located a distance D1 from bottom end 238 of inlet chamber 226 and inlet plenum 230. Although the microchannels 234 extend from inlet plenum 230, the location of the microchannels 234 places the microchannel entrances 236 at the same height as the rounded portion of inlet chamber 222 that is interrupted by inlet plenum 230.

The design shown in FIGS. 39 and 40 allows the fluid flowing through inlet chamber 222 to enter inlet plenum 230 before reaching the bottom end 238 of inlet chamber 222. It has been determined that this design avoids undesired flow recirculation regions inside plenum 230 and poor flow distribution between the plurality of microchannels 234. In the embodiment shown, the width of inlet plenum 230 has been reduced to about half of the diameter of inlet chamber 226. In alternative embodiments, the width of inlet plenum 230 can be in the range of 0.001 to 1 inch, and the height of inlet plenum 230 can be in the range of 0.001 to 1 inch.

Although not shown in the FIGS. 39 and 40, outlet plenum 132 can be similarly constructed so that the width of outlet plenum 130 is smaller than the diameter of outlet chamber 126, and so that the height of outlet plenum 132 has been increased. The plurality of microchannels can have the same or different cross-sectional areas and dimensions.

Figure 41:
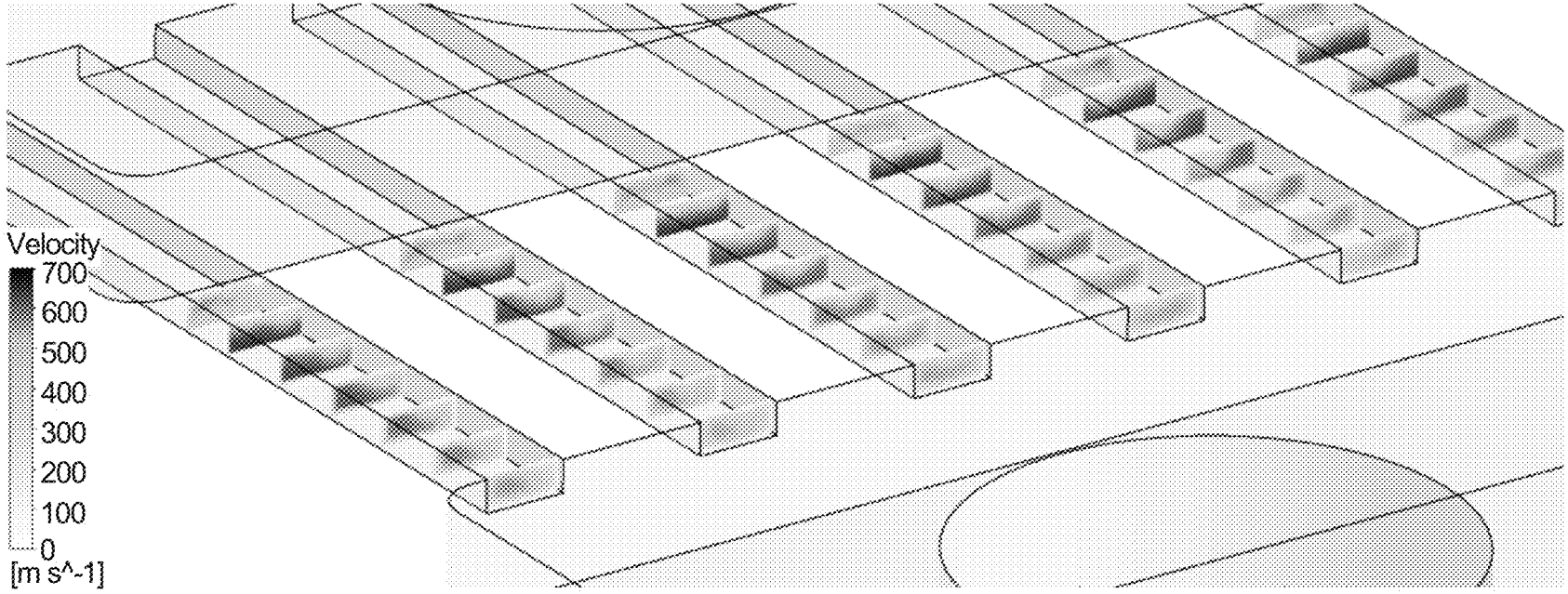
FIG. 41 depicts a diagram of the cavitation effect of the interaction chamber of FIG. 37.
Figure 42:
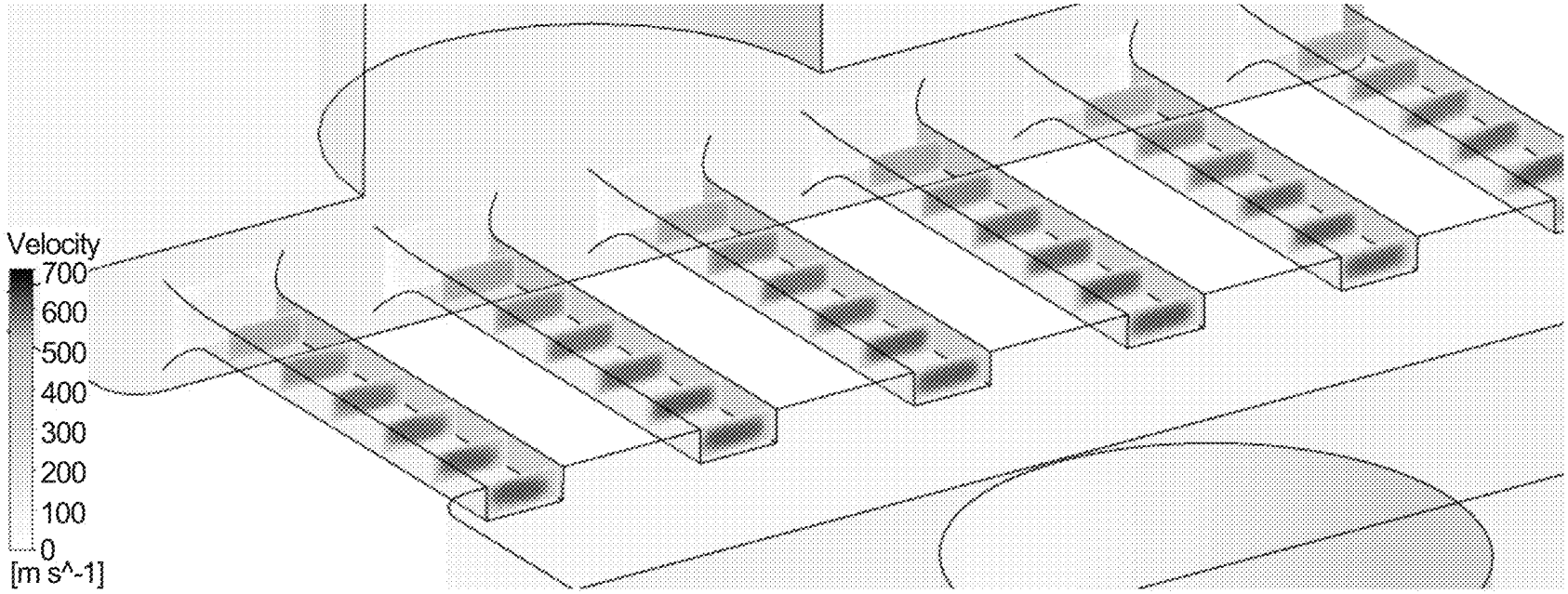
FIG. 42 depicts a diagram of the cavitation effect of the interaction chamber of FIG. 39.

FIGS. 41 and 42 show the velocity profiles of interaction chamber 200 and interaction chamber 220, respectively, using a computational fluid dynamics simulation. As shown in FIG. 41, the velocity profiles for interaction chamber 200 are not uniformly distributed from channel to channel. This non-uniformity could lead to variations of the processed materials between microchannels as well as the plugging of certain materials. Interaction chamber 220 reduces the variations between flow characterizations between microchannels as indicated by the uniform velocity profiles across all channels in FIG. 42. This leads to less plugging occurrences when processing certain materials. Further, the maximum predicted temperature inside the channel for interaction chamber 220 is significantly reduced by about 15° C. from 84° C. to 69° C.

Figure 43:
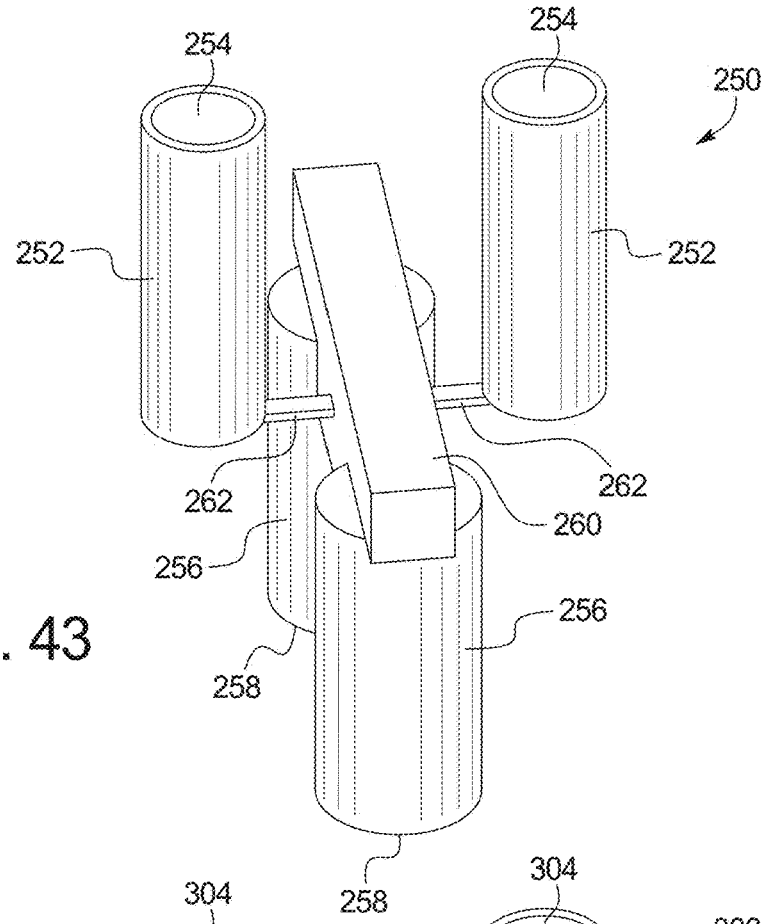
FIG. 43 depicts a top perspective view of an example embodiment of an interaction chamber.

FIG. 43 shows an example embodiment of the working section of a Y-type interaction chamber 250. Interaction chamber 250 includes two inlet chambers 252 with inlet holes 254, two outlet chambers 256 with outlet holes 258, an outlet plenum 260 connected to the two outlet chambers 256, and a plurality of microchannels 262 connecting the two inlet chambers 252 to the outlet plenum 260. The inlet chambers 252 and outlet chambers 256 are preferably cylinders. In use, incoming fluid enters inlet holes 254, passes through the two inlet chambers 252, and then enters the microchannels 262. The fluid then exits the microchannels 262 into outlet plenum 260, passes through the two outlet chambers 256, and exits through outlet holes 258. The outlet of the microchannel may also have a chamfer, forming a divergent or convergent jet.

The interaction chamber 250 of FIG. 43 is generally referred to as a Y-type interaction chamber herein due to its Y-shape formed by two inlets and two outlets. Y-type interaction chambers such as interaction chamber 250 use two jet streams from opposing microchannels cause the fluid to impinge at the outlet plenum. That is, the two jet streams collide with each other in the outlet plenum.

Figure 44:
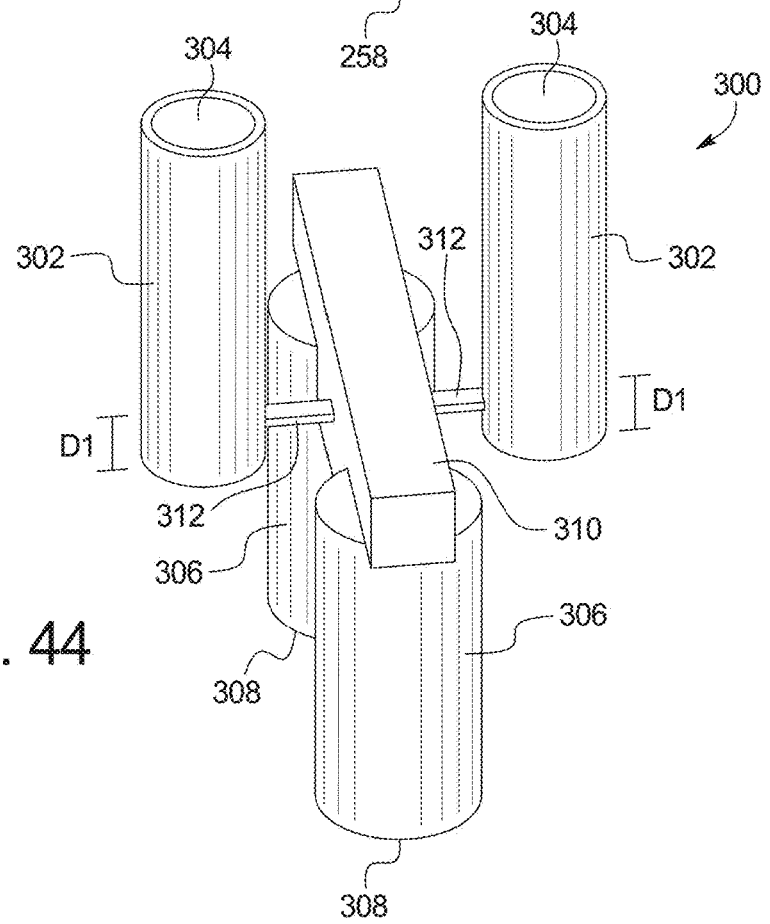
FIG. 44 depicts a top perspective view of an example embodiment of an interaction chamber.

FIG. 44 shows an example embodiment of the working section of an improved H-impinging jet (HIJ-type) interaction chamber 300 according to the present disclosure. Interaction chamber 300 includes two inlet chambers 302 with inlet holes 304, two outlet chambers 306 with outlet holes 308, an outlet plenum 310 connected to the two outlet chambers 306, and a plurality of microchannels 312 connecting the two inlet chambers 302 to the outlet plenum 310. The inlet chambers 302 and outlet chambers 306 are preferably cylinders. As illustrated, the microchannels 312 are located a distance D1 from bottom ends 314 of the inlet chambers 302. In an embodiment, D1 can be in the range of 0.001 to 1 inch, or preferably 0.01 to 0.03 inches. It has been determined that adding the distance D1 between the microchannels 312 and the bottom ends 314 of the inlet chambers 302 streamlines the flow when it enters microchannels 312 and reduces the level of cavitation.

The interaction chamber 300 of FIG. 44 is generally referred to as an HIJ-type interaction chamber herein due to its H-shape and use of at least two microchannels to form impinging jets within the outlet plebum. The difference between a Y-type chamber and an HIJ-type chamber is the distance from the microchannel entrance to the bottom end of the inlet chamber. Like Y-type chambers, HIJ-type chambers such as interaction chamber 300 are useful in reducing particle size by impingement of two opposing jets inside the outlet plebum.

Table 8 shows the emulsion results for interaction chamber 300 compared to Y-Chamber 1 and Y-Chamber 2 above.

TABLE 8

Emulsion Formulation 2 Test Results

| Chamber | Pressure (kpsi) | # Pass | D10 (nm) | D50 (nm) | D90 (nm) | D95 (nm) | Vol % of 2nd Peak |
|---|---|---|---|---|---|---|---|
| IXC-300 | 25 | 1 | 76.8 | 128.1 | 231.6 | 811.8 | 5.24 |
| | | 2 | 75.8 | 123.0 | 195.7 | 223.3 | 0.21 |
| | | 3 | 75.1 | 120.4 | 188.9 | 213.7 | 0.00 |
| Y-Chamber 1 | 25 | 1 | 79.5 | 136 | 296.5 | 1524.2 | 8.61 |
| | | 2 | 77.1 | 127.4 | 211.8 | 250.7 | 1.82 |
| | | 3 | 76.0 | 122.9 | 194.3 | 220.8 | 0.00 |
| Y-Chamber 2 | 25 | 1 | 88.4 | 157.9 | 658.2 | 1652.6 | 9.98 |
| | | 2 | 84.7 | 145.3 | 246.5 | 294.3 | 2.05 |
| | | 3 | 82.7 | 139.2 | 222.6 | 253.4 | 0.00 |

Figure 45:
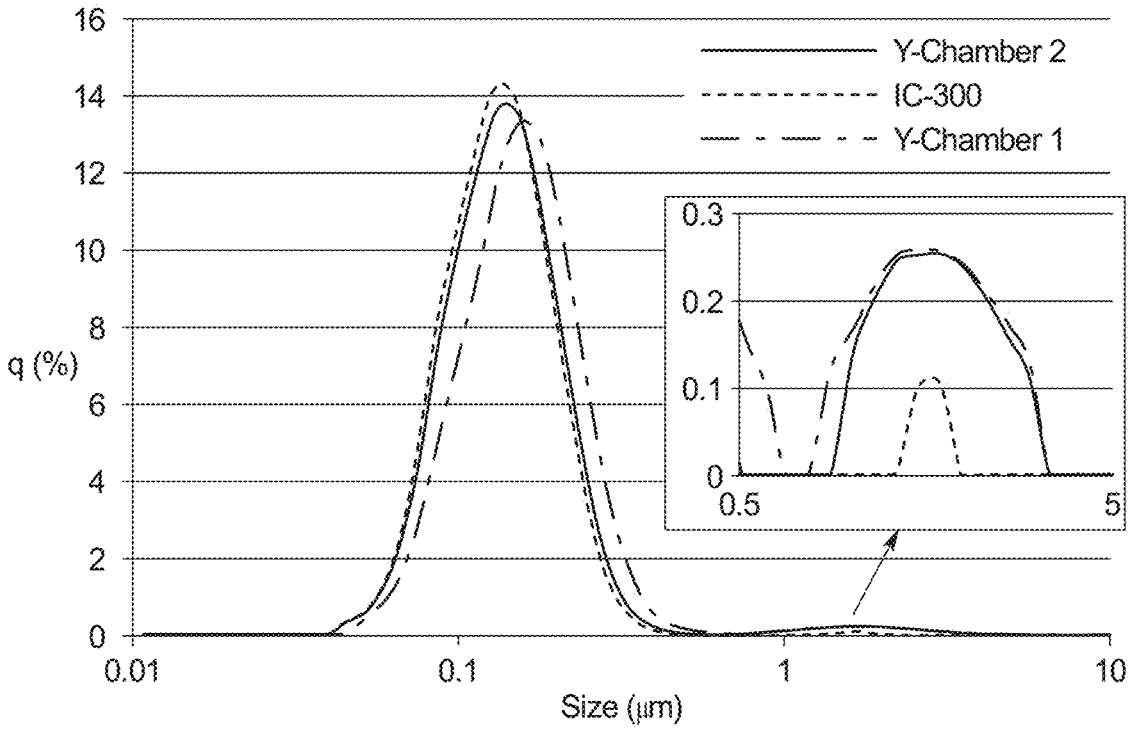
FIG. 45 depicts a diagram of particle size distribution.

Computational fluid dynamics ("CFD") predicts that the average channel exit velocity for interaction chamber 300 is increased by approximately 4%, which means that the fluid carries more kinetic energy for the subsequent jet impingement. When the higher available energy dissipates due to the collision of the two liquid jets, smaller droplets will form and can remain stable. Table 8 shows that interaction chamber 300 provides better emulsion results for emulsion formulation 2. Particle sizes for all passes are smaller, especially for the D90 and D95 values, e.g., from 16 nm to 70 nm for the second pass. Furthermore, the volume percentage of the second peak, which indicates the presence of large particles that often lead to emulsion instabilities, is about 88% less (0.21% vs. 1.82%) compared to Y-Chamber 1 and 90% less (0.21% vs. 2.05%) compared to Y-Chamber 2 for the second pass. FIG. 45 shows a graphic representation of the particle size distribution and area of the second peak for interaction chamber 300 for emulsion formulation 2 after the second pass.

Figure 46:
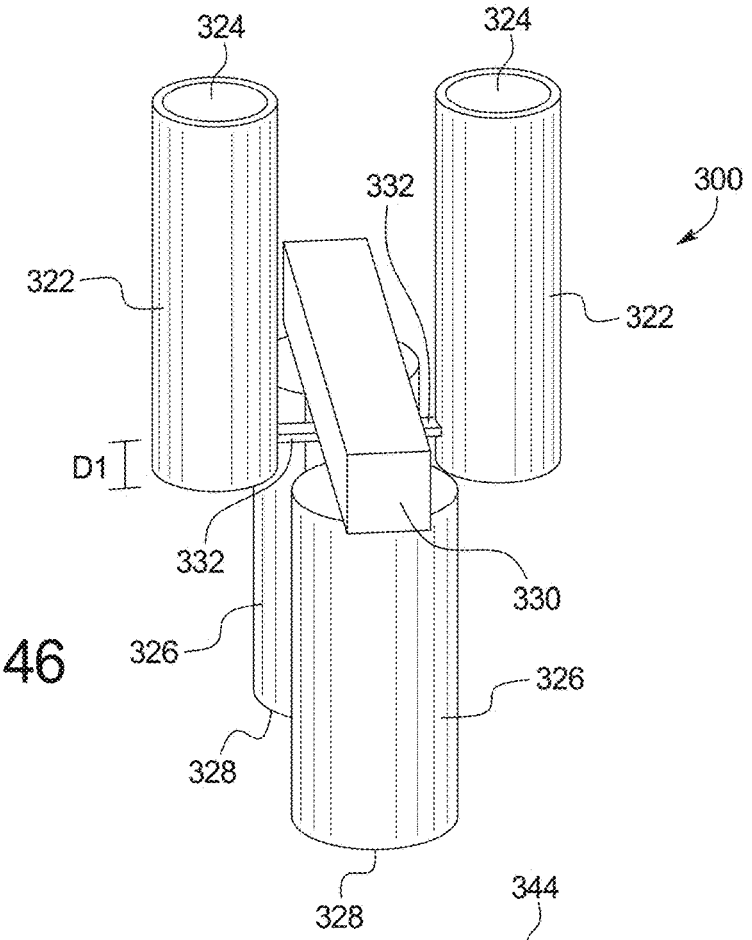
FIG. 46 depicts a top perspective view of an example embodiment of an interaction chamber.

FIG. 46 shows an example embodiment of the working section of an improved HIJ-type interaction chamber 320 according to the present disclosure. H-impinging jet chamber 320 includes two inlet chambers 322 with inlet holes 324, two outlet chambers 326 with outlet holes 328, an outlet plenum 330 connected to the two outlet chambers 326, and a plurality of microchannels 332 connecting the two inlet chambers 322 to the outlet plenum 330. The inlet chambers 322 and outlet chambers 326 are preferably cylinders. Microchannels 332 are located a distance D1 from the bottom ends 314 of the inlet chambers 302. Interaction chamber 320 further reduces the lengths of the microchannels 332. In an embodiment, the microchannel length is reduced by about 45% and the predicted average channel exit velocity is increased by approximately 9%. This allows the two impinging jets to carry more energy for dissipation and forming smaller stable particles.

Figure 47:
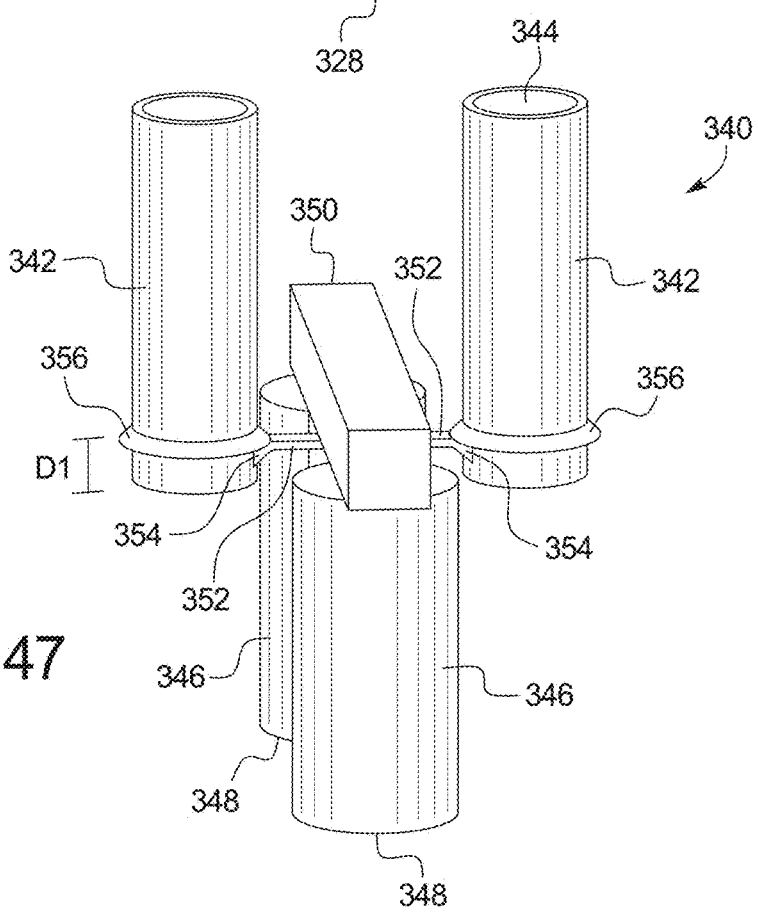
FIG. 47 depicts a top perspective view of an example embodiment of an interaction chamber.

FIG. 47 shows an example embodiment of the working section of an improved HIJ-type interaction chamber 340 according to the present disclosure. H-impinging jet chamber 340 includes two inlet chambers 342 with inlet holes 344, two outlet chambers 346 with outlet holes 348, an outlet plenum 350 connected to the two outlet chambers 346, and a plurality of microchannels 352 connecting the two inlet chambers 342 to the outlet plenum 350. The inlet chambers 342 and outlet chambers 346 are preferably cylinders.

Microchannels 352 are located a distance D1 from the bottom ends 344 of the inlet chambers 352. Interaction chamber 340 further removes the sharp edges around the microchannel 352 entrance by adding tapered fillets 354 at the top, bottom and side walls of the microchannel entrance. In an embodiment, the tapered fillets 354 can be in the range of 0.001 to 1 inch. The top portion 356 of the fillet 354 further extends all the way around the outer circumference of the two inlet chambers 342. It has been determined that interaction chamber 340 provides a streamlined flow pattern and completely removes cavitation. In this embodiment, the predicted average channel exit velocity is increased by approximately 11% as compared to interaction chamber 250, which allows the two impinging jets to carry more energy for dissipation and forming smaller stable particles.

Figure 48:
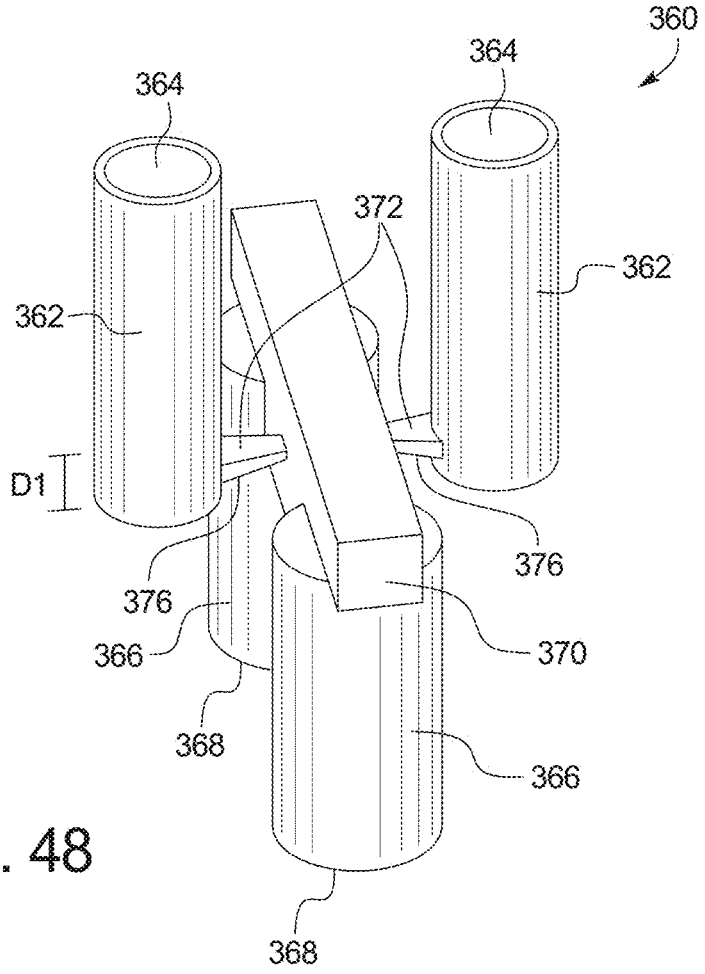
FIG. 48 depicts a top perspective view of an example embodiment of an interaction chamber.

FIG. 48 shows an example embodiment of the working section of an improved HIJ-type interaction chamber 360 according to the present disclosure. H-impinging jet chamber 360 includes two inlet chambers 362 with inlet holes 364, two outlet chambers 366 with outlet holes 368, an outlet plenum 370 connected to the two outlet chambers 366, and a plurality of microchannels 372 connecting the two inlet chambers 362 to the outlet plenum 370. The inlet chambers 362 and outlet chambers 366 are preferably cylinders. Microchannels 372 are located a distance D1 from the bottom ends 374 of the inlet chambers 362. Interaction chamber 360 further drafts the side walls 376 of the microchannels 372 so that the side walls converge from the inlet chambers 362 to the outlet plenum 370. The top and bottom wall of the microchannels 372 can likewise be drafted to converge from converge from the inlet chambers 362 to the outlet plenum 370. In different embodiments, the side walls 376, bottom wall and/or top wall can constantly converge from the inlet chamber 362 to outlet plenum 370, or can converge on only part of the length of the microchannels 372. In an embodiment, the draft angle of side walls 376, bottom wall and/or top wall can be between 1 degree and 30 degrees. It has been determined that interaction chamber 360 provides the highest fluid energy at the channel exit for a given dimension.

In alternative embodiments, any of the features of the above-described interaction chambers can be combined. Further, all of the above embodiments can be used with an Auxiliary Processing Module ("APM") positioned either upstream or downstream of the interaction chambers disclosed herein. An APM is an oversized Z-type of H-type chamber, either single or multi-slotted, that can reduce the pressure drop across the interaction chamber about 5% to 30% when placed upstream or downstream. In an embodiment, an APM can be placed in series with an interaction chambers disclose herein, so that the APM is positioned either upstream or downstream of the interaction chamber.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

Additional Aspects of the Present Disclosure

Aspects of the subject matter described herein may be useful alone or in combination with any one or more of the other aspect described herein. Without limiting the foregoing description, in a first aspect of the present disclosure, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, wherein an entrance to the microchannel from the inlet chamber is offset a distance from the bottom end of the inlet chamber, and at least one of, at least two of, at least three of, or all four of: (i) at least one tapered fillet located on at least one side wall of the microchannel at the microchannel entrance; (ii) at least one side wall of the microchannel converging inwardly from the inlet chamber to the outlet chamber; (iii) at least one of a top wall and a bottom wall of the microchannel angled from the inlet chamber to the outlet chamber; and (iv) a top fillet that extends around a diameter of inlet chamber In accordance with a second aspect of the present disclosure, which may be used in combination with any other aspect or combination of aspects listed herein, the interaction chamber is at least one of an H-type interaction chamber, a Y-type interaction chamber, a Z-type interaction chamber and an HIJ-type interaction chamber.

In accordance with a third aspect of the present disclosure, which may be used in combination with any other aspect or combination of aspects listed herein, an exit from the microchannel to the outlet chamber at least one of, or both of: (i) is offset a distance from the top end of the outlet chamber; and (ii) includes at least one second tapered fillet.

In accordance with a fourth aspect of the present disclosure, which may be used in combination with any other aspect or combination of aspects listed herein, the distance between the microchannel entrance and the bottom end of the inlet chamber is in the range of 0.001 to 1 inch, preferably 0.01 to 0.03 inches.

In accordance with a fifth aspect of the present disclosure, which may be used in combination with any other aspect or combination of aspects listed herein, the at least one tapered fillet is at least one of, or both of: (i) a rounded fillet; and (ii) located on a plurality of sides of the microchannel at the microchannel entrance.

In accordance with a sixth aspect of the present disclosure, which may be used in combination with any other aspect or combination of aspects listed herein, at least one of, or both of: (i) both side walls converge from the inlet chamber to the outlet chamber; and (ii) the top wall and the bottom wall both converge from the inlet chamber to the outlet chamber.

In accordance with a seventh aspect of the present disclosure, which may be used in combination with any other aspect or combination of aspects listed herein, a multi-slotted interaction chamber for a fluid processor or fluid homogenizer, preferably a high shear processor or a high pressure homogenizer, includes an inlet chamber, preferably an inlet cylinder, having an inlet hole and a bottom end, an inlet plenum in fluid communication with the inlet hole, an outlet chamber, preferably an outlet cylinder, having an outlet hole and a top end, an outlet plenum in fluid communication with the outlet hole, and a plurality of microchannels connecting the inlet plenum to the outlet plenum and thereby fluidly connecting the inlet hole with the outlet hole, each of the plurality of microchannels including a microchannel entrance offset a distance from the bottom end of the inlet chamber, wherein at least one of, or both of: (i) a width of the inlet plenum is less than a diameter of the inlet chamber; and (ii) a height of the inlet plenum interrupts the diameter of the inlet chamber.

In accordance with an eighth aspect of the present disclosure, which may be used in combination with any other aspect or combination of aspects listed herein, the interaction chamber is at least one of an H-type interaction chamber, a Y-type interaction chamber, a Z-type interaction chamber and an HIJ-type interaction chamber.

In accordance with a ninth aspect of the present disclosure, which may be used in combination with any other aspect or combination of aspects listed herein, at least one of, or both of: (i) a width of the outlet plenum is less than a diameter of the outlet chamber and a height of the outlet plenum interrupts the outlet chamber; (ii) the at least one microchannel is offset a distance from the top end of the outlet chamber; and (iii) the inlet plenum shares the bottom end with the inlet chamber.

In accordance with a tenth aspect of the present disclosure, which may be used in combination with any other aspect or combination of aspects listed herein, the interaction chamber includes at least one tapered fillet located at one of the microchannel entrances.

In accordance with an eleventh aspect of the present disclosure, which may be used in combination with any other aspect or combination of aspects listed herein, the at least one tapered fillet is located on a plurality of sides of the microchannel at the microchannel entrance.

In accordance with a twelfth aspect of the present disclosure, which may be used in combination with any other aspect or combination of aspects listed herein, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, and means for reducing cavitation as fluid enters the microchannel from the inlet chamber.

In accordance with a thirteenth aspect of the present disclosure, which may be used in combination with any other aspect or combination of aspects listed herein, the interaction chamber includes means for reducing cavitation as fluid exits the microchannel to the outlet chamber.

In accordance with a fourteenth aspect of the present disclosure, which may be used in combination with any other aspect or combination of aspects listed herein, the means for reducing cavitation as fluid enters the microchannel from the inlet chamber includes at least one of, at least two of, at least three of, or all four of: (i) a tapered fillet; (ii) an offset distance between the bottom end and the inlet hole; (iii) a microchannel wall converging from the inlet chamber to the outlet chamber; and (iv) a fillet that extends around a diameter of the inlet chamber.

In accordance with a fifteenth aspect of the present disclosure, which may be used in combination with any other aspect or combination of aspects listed herein, the means for reducing cavitation as fluid exits the microchannel to the outlet chamber includes at least one of, at least two of, at least three of, or all four of: (i) a tapered fillet; (ii) an offset distance between the top end and the outlet hole; (iii) a microchannel wall converging from the inlet chamber to the outlet chamber; and (iv) a fillet that extends around a diameter of the outlet chamber.

In accordance with a sixteenth aspect of the present disclosure, which may be used in combination with any other aspect or combination of aspects listed herein, an interaction chamber for a fluid processor or fluid homogenizer, preferably a high shear processor or high pressure homogenizer, includes an entry chamber, preferably an entry cylinder, an outlet chamber, preferably an outlet cylinder, a microchannel in fluid communication with the entry chamber and outlet chamber, the microchannel having an inlet and an outlet, wherein the entry chamber has an inlet hole at or near the top of the entry chamber and receives the microchannel inlet at a position above a bottom of the entry chamber.

In accordance with a seventeenth aspect of the present disclosure, which may be used in combination with any other aspect or combination of aspects listed herein, the microchannel is positioned so that the inlet is at a different height than the outlet.

In accordance with an eighteenth aspect of the present disclosure, which may be used in combination with any other aspect or combination of aspects listed herein, the inlet is higher than the outlet.

In accordance with a nineteenth aspect of the present disclosure, which may be used in combination with any other aspect or combination of aspects listed herein, the microchannel is tapered, slanted, or both.

In accordance with a twentieth aspect of the present disclosure, which may be used in combination with any other aspect or combination of aspects listed herein, the outlet of the microchannel joins the outlet chamber at a position at or below a top of the outlet chamber.

In accordance with a twenty-first aspect of the present disclosure, which may be used in combination with any other aspect or combination of aspects listed herein, the microchannel outlet is positioned below the top of the outlet chamber.

In accordance with a twenty-second aspect of the present disclosure, which may be used in combination with any other aspect or combination of aspects listed herein, the microchannel inlet is disposed above the bottom of the inlet chamber, and the microchannel outlet is disposed below the top of the outlet chamber.

In accordance with a twenty-third aspect of the present disclosure, which may be used in combination with any other aspect or combination of aspects listed herein, the microchannel includes a plurality of microchannels.

In accordance with a twenty-fourth aspect of the present disclosure, which may be used in combination with any other aspect or combination of aspects listed herein, the plurality of microchannels interface with a first intermediate plenum or reservoir disposed between the entry chamber and the inlet to the microchannels.

In accordance with a twenty-fifth aspect of the present disclosure, which may be used in combination with any other aspect or combination of aspects listed herein, the plenum extends below the microchannel inlet.

In accordance with a twenty-sixth aspect of the present disclosure, which may be used in combination with any other aspect or combination of aspects listed herein, the interaction chamber includes a second intermediate plenum disposed between the outlet from the microchannels and the outlet chamber.

In accordance with a twenty-seventh aspect of the present disclosure, which may be used in combination with any other aspect or combination of aspects listed herein, the interaction chamber is at least one of an H-type interaction chamber, a Y-type interaction chamber, a Z-type interaction chamber and an HIJ-type interaction chamber.

In accordance with a twenty-eighth aspect of the present disclosure, which may be used in combination with any other aspect or combination of aspects listed herein, at least one microchannel has a cross-section in the shape of a rectangle, square, trapezoid, triangle or circle.

In accordance with a twenty-ninth aspect of the present disclosure, which may be used in combination with any other aspect or combination of aspects listed herein, a fluid processing system includes an auxiliary processing module (APM) positioned upstream or downstream of the interaction chamber described herein.

In accordance with a thirtieth aspect of the present disclosure, which may be used in combination with any other aspect or combination of aspects listed herein, the fluid processing system includes a plurality of interaction chambers, at least one of such interaction chambers being an interaction chamber described herein.

In accordance with a thirty-first aspect of the present disclosure, which may be used in combination with any other aspect or combination of aspects listed herein, the fluid processing system includes multiple interaction chambers positioned in series or in parallel.

In accordance with a thirty-second aspect of the present disclosure, which may be used in combination with any other aspect or combination of aspects listed herein, the fluid processing system includes an APM positioned upstream from at least one interaction chamber described herein and/or an APM positioned downstream from at least one interaction chamber described herein.

In accordance with a thirty-third aspect of the present disclosure, which may be used in combination with any other aspect or combination of aspects listed herein, a method of producing an emulsion includes passing fluid through an interaction chamber described herein.

In accordance with a thirty-fourth aspect of the present disclosure, which may be used in combination with any other aspect or combination of aspects listed herein, a method of producing reducing particle size includes passing a particle stream through an interaction chamber described herein.

In accordance with a thirty-fifth aspect of the present disclosure, which may be used in combination with any other aspect or combination of aspects listed herein, a fluid processing system including an interaction chamber described herein, the fluid processing system causing fluid to flow above 0 kpsi and below 40 kpsi within the microchannel of the interaction chamber.

In accordance with a thirty-sixth aspect of the present disclosure, which may be used in combination with any other aspect or combination of aspects listed herein, an interaction chamber for a fluid processor or fluid homogenizer, preferably a high shear processor or a high pressure homogenizer, includes an inlet chamber, preferably an inlet cylinder, having an inlet hole and a bottom end, an outlet chamber, preferably an outlet cylinder, having an outlet hole and a top end, a microchannel placing the inlet hole in fluid communication with the outlet hole, wherein an exit from the microchannel to the outlet chamber is offset a distance from the top end of the outlet chamber, and at least one of, at least two of, at least three of, or all four of: (i) at least one tapered fillet located on at least one side wall of the microchannel at the microchannel exit; (ii) at least one side wall of the microchannel converging inwardly from the inlet chamber to the outlet chamber; (iii) at least one of a top wall and a bottom wall of the microchannel angled from the inlet chamber to the outlet chamber; and (iv) a top fillet that extends around a diameter of inlet chamber.

In accordance with a thirty-seventh aspect of the present disclosure, which may be used in combination with any other aspect or combination of aspects listed herein, the interaction chamber is at least one of an H-type interaction chamber, a Y-type interaction chamber, a Z-type interaction chamber and an HIJ-type interaction chamber.

In accordance with a thirty-eighth aspect of the present disclosure, which may be used in combination with any other aspect or combination of aspects listed herein, the at least one tapered fillet is at least one of, or both of: (i) a rounded fillet; and (ii) located on a plurality of sides of the microchannel at the microchannel entrance.

We claim:

1. An interaction chamber for a fluid processor or fluid homogenizer comprising:

a vertically-disposed cylindrical inlet chamber including an inlet hole and a bottom end;

a vertically-disposed cylindrical outlet chamber including an outlet hole and a top end;

a microchannel directly connected to at least one of the inlet chamber or the outlet chamber and connecting the inlet chamber to the outlet chamber, wherein an entrance to the microchannel from the inlet chamber is offset a distance from the bottom end of the inlet chamber, and wherein an exit from the microchannel to the outlet chamber is offset a distance from the top end of the outlet chamber, wherein the inlet chamber, the outlet chamber and the microchannel create a flow path that lies within a single plane, the flow path extending from the inlet hole, through the microchannel, to the outlet hole.

2. The interaction chamber of claim 1, wherein the microchannel is directly connected to both the inlet chamber and the outlet chamber.

3. The interaction chamber of claim 1, wherein the inlet chamber and the outlet chamber are substantially parallel, creating an inlet portion of the flow path and an outlet portion of the flow path that are substantially parallel within the single plane.

4. The interaction chamber of claim 1, wherein the flow path includes a straight portion within the single plane from the microchannel exit to the outlet hole.

5. The interaction chamber of claim 1, wherein the flow path includes (i) a first flow path extending within the single plane from the inlet hole to the microchannel entrance, (ii) a second flow path extending within the single plane from the microchannel entrance to the microchannel exit in a substantially perpendicular direction to the first flow path, and (iii) a third flow path extending within the single plane from the microchannel exit to the outlet hole in a substantially parallel direction to the first flow path.

6. The interaction chamber of claim 1, which does not include an additional chamber between the microchannel exit and the outlet chamber.

7. The interaction chamber of claim 1, wherein the entrance to the microchannel from the inlet chamber is offset from the bottom end of the inlet chamber by a distance of about 0.001 to 1 inches.

8. The interaction chamber of claim 7, wherein a diameter of the microchannel is smaller than the distance of the offset from the bottom end of the inlet chamber.

9. The interaction chamber of claim 1, wherein the exit from the microchannel to the outlet chamber is offset from the top end of the outlet chamber by a distance of about 0.001 to 1 inches.

10. The interaction chamber of claim 9, wherein a diameter of the microchannel is smaller than the distance of the offset from the top end of the outlet chamber.

11. The interaction chamber of claim 1, wherein the entrance to the microchannel from the inlet chamber is offset from the bottom end of the inlet chamber by a distance of about 0.01 to 0.03 inches.

12. The interaction chamber of claim 11, wherein a diameter of the microchannel is smaller than the distance of the offset from the bottom end of the inlet chamber.

13. The interaction chamber of claim 1, wherein the exit from the microchannel to the outlet chamber is offset from the top end of the outlet chamber by a distance of about 0.01 to 0.03 inches.

14. The interaction chamber of claim 13, wherein a diameter of the microchannel is smaller than the distance of the offset from the top end of the outlet chamber.

15. A fluid processor including the interaction chamber of claim 1, wherein the fluid processor causes fluid to flow above 0 kpsi and below 40 kpsi through the microchannel.

16. A fluid homogenizer including the interaction chamber of claim 1, wherein the fluid homogenizer causes fluid to flow above 0 kpsi and below 40 kpsi through the microchannel.

17. A method of producing an emulsion, comprising:
passing fluid through the interaction chamber of claim 1.

18. A method of reducing particle size, comprising:
passing a particle stream through the interaction chamber of claim 1.

19. A method of producing a fluid dispersion, comprising:
passing a flowable material including particles through the interaction chamber of claim 1.

* * * * *